US005264330A

United States Patent [19]

Yoshida et al.

[11] Patent Number: 5,264,330

[45] Date of Patent: Nov. 23, 1993

[54] METHOD FOR PROCESSING A SILVER HALIDE COLOR PHOTOGRAPHIC MATERIAL

[75] Inventors: Kazuaki Yoshida; Takatoshi Ishikawa, both of Minami-ashigara, Japan

[73] Assignee: Fuji Photo Film Co. Ltd., Kanagawa, Japan

[21] Appl. No.: 668,567

[22] Filed: Mar. 13, 1991

[30] Foreign Application Priority Data

Mar. 13, 1990 [JP] Japan ..... 2-62336

[51] Int. Cl.[5] ..... G03C 7/30

[52] U.S. Cl. ..... 430/351; 430/372; 430/376; 430/382; 430/389; 430/469; 430/466; 430/486; 430/487; 430/488; 430/489; 430/963

[58] Field of Search ..... 430/466, 467, 486, 487, 430/488, 489, 490, 493, 372, 376, 382, 389, 351, 963, 469

[56] References Cited

U.S. PATENT DOCUMENTS

| | | | |
|---|---|---|---|
| 4,937,178 | 6/1990 | Koboshi et al. | 430/376 |
| 5,070,003 | 12/1991 | Naruse et al. | 430/467 |
| 5,093,227 | 3/1992 | Nakazyo et al. | 430/467 |
| 5,153,111 | 10/1992 | Yoshida et al. | 430/486 |

*Primary Examiner*—Richard L. Schilling
*Attorney, Agent, or Firm*—Sughrue, Mion, Zinn, Macpeak & Seas

[57] ABSTRACT

There is disclosed a method for processing a silver halide color photographic material containing a yellow coupler represented by formula (Y) with a color developer containing an aromatic primary amine color developing agent and a polymer of vinyl alcohol or vinyl pyrrolidone series. The disclosure described provides a method for development processing wherein yellow stain and processing nonuniformity in a running processing can be prevented effectively.

21 Claims, No Drawings

METHOD FOR PROCESSING A SILVER HALIDE COLOR PHOTOGRAPHIC MATERIAL

FIELD OF THE INVENTION

The present invention relates to a method for processing a silver photographic material, and more particularly to a development processing method wherein an increase of yellow stain and streak-like processing streak, which will otherwise occur in continuous processing, are prevented.

BACKGROUND OF THE INVENTION

In recent years, in photographic processing of color photographic materials, it has been desired to shorten the processing time as the time of delivery of the finished product has become shortened and the labor of the photofinishing lab work has lessened. As a measure for shortening the time in each processing step, although increasing the temperature or increasing the replenishing amount is a general technique, a number of other techniques, including enhancement of the stirring or the addition of various accelerators, have been suggested.

However, it has been revealed that when the development activity is simply increased by the above techniques, an increase of yellow stain and streak-like processing streak occurs with the progress of continuous processing using an automatic processor.

The present inventors have studied in various ways and have found that yellow stain is fogging of yellow.

In rapid processing, to reduce fogging, it is known to use organic antifoggants as disclosed in JP-A ("JP-A" means unexamined published Japanese patent application) Nos. 95345/1983 and 232342/1984. However, their antifogging ability is short of full prevention of the increase of fogging and streak-like fogging involved in continuous processing, and the use of a large amount of organic antifoggants results in a decrease of the maximum density and a delay of the development, failing to solve the above problems.

Further, to reduce fogging of yellow, it is known to use pivaloyl-type yellow couplers described in JP-A No. 26133/1972. In comparison with benzoyl-type yellow couplers, pivaloyl-type yellow couplers reduce yellow fog but the reduction is not yet adequate, also failing to solve the above problems.

SUMMARY OF THE INVENTION

Therefore, the first object of the present invention is to provide a method for processing a silver halide color photographic material wherein an increase of the yellow minimum density, which will otherwise occur with the progress of continuous processing, is prevented and a color photographic image good in whiteness is obtained.

The second object of the present invention is to provide a method for processing a silver halide color photographic material wherein streak-like processing streak, which will otherwise take place with the progress of continuous processing, is prevented from occurring.

Other and further objects, features, and advantages of the invention will appear more fully from the following description.

DETAILED DESCRIPTION OF THE INVENTION

The objects of the present invention have been attained by providing a method for processing a silver halide color photographic material with a color developer containing at least one aromatic primary amine color-developing agent, characterized in that said photographic material contains at least one of yellow couplers represented by the following formula (Y):

Formula (Y)

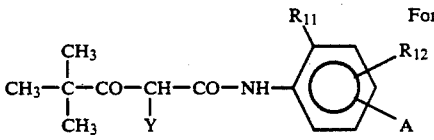

wherein $R_{11}$ represents a halogen atom, an alkoxy group, a trifluoromethyl group, or an aryl group, $R_{12}$ represents a hydrogen atom, a halogen atom, or an alkoxy group, A represents $—NHCOR_{13}$, $—NHSO_2—R_{13}$, $—SO_2NHR_{13}$, 0.1h8 $—COOR_{13}$ or

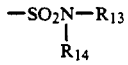

wherein $R_{13}$ and $R_{14}$ each represent an alkyl group, an aryl group, or an acyl group, and Y represents a group capable of being released, and said color developer contains at least one selected from the group consisting of vinyl alcohol homopolymers, vinyl alcohol copolymers, vinyl pyrrolidone homopolymers, and vinyl pyrrolidone copolymers.

In formula (Y), as a substituent of $R_{12}$ and $R_{13}$, a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, and a cyano group can be mentioned.

The group capable of being released Y includes groups represented by the following formulae (Xa) to (Xd):

(Xa)

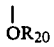

wherein $R_{20}$ represents an optionally substituted aryl or heterocyclic group.

(Xb)

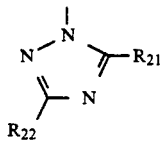

(Xc)

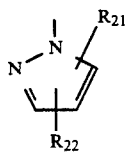

wherein $R_{21}$ and $R_{22}$, which may be the same or different, each represent a hydrogen atom, a halogen atom, a carboxylate group, an amino group, an alkyl group, an alkylthio group, an alkoxy group, an alkylsulfonyl group, an alkylsulfinyl group, a carboxylic acid group, a sulfonic acid group, or a substituted or unsubstituted phenyl or heterocyclic group.

(Xd)

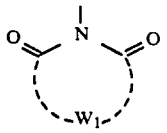

wherein $W_1$ represents a group of nonmetallic atoms required to form a 4-, 5- or 6-membered ring together with the

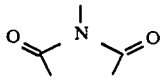

in the formula.

Of formula (Xd), formulae (Xe) to (Xg) are preferred.

(Xe)

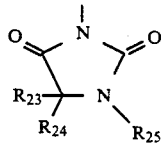

(Xf)

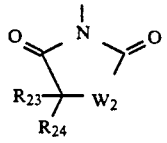

(Xg)

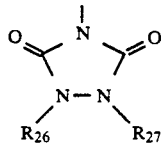

In the formulae (Xe), (Xf), and (Xg), $R_{23}$ and $R_{24}$ each represent a hydrogen atom, an alkyl group, an aryl group, an alkoxy group, an aryloxy group, or a hydroxy group, $R_{25}$, $R_{26}$, and $R_{27}$ each represent a hydrogen atom, an alkyl group, an aryl group, an aralkyl group, or an acyl group, and $W_2$ represents an oxygen atom or a sulfur atom.

Specific examples of these couplers are given below.

(Y-1)

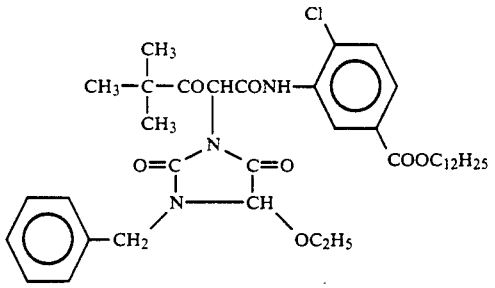

(Y-2)

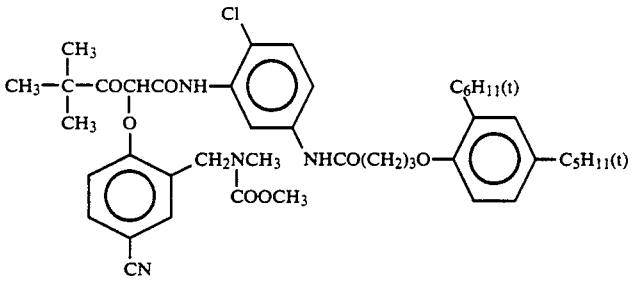

(Y-3)

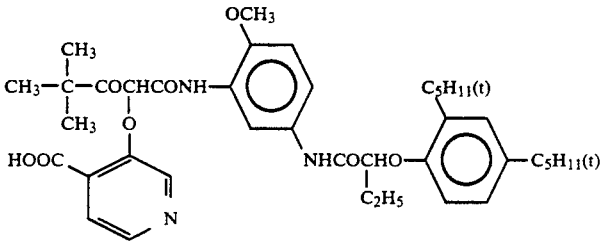

-continued
(Y-4)
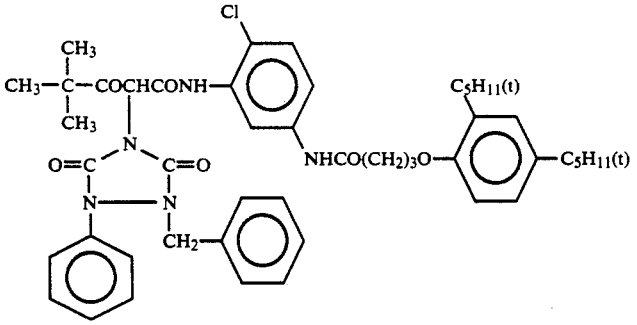
(Y-5)
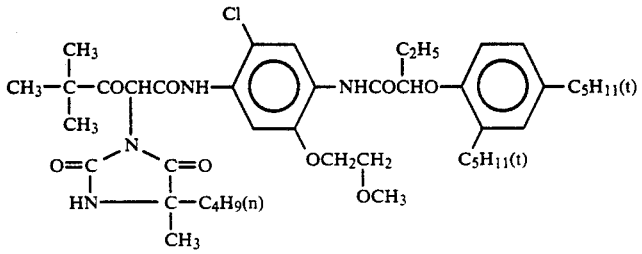
(Y-6)
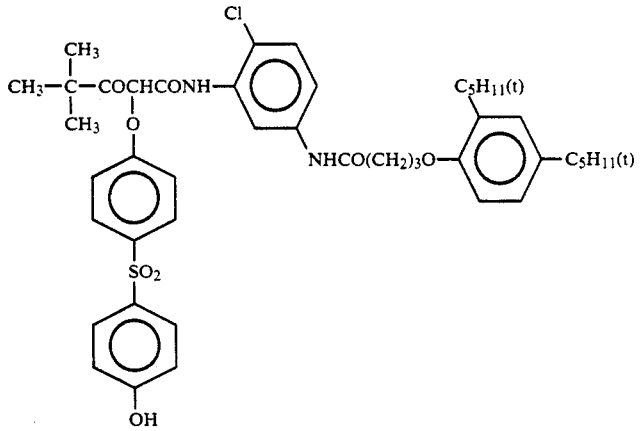
(Y-7)
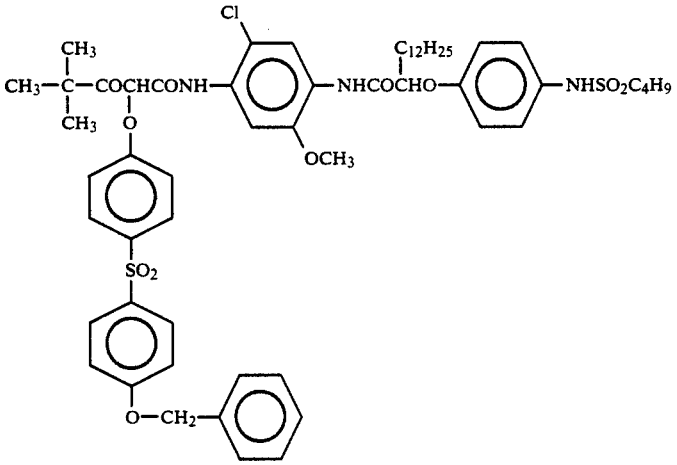

-continued
(Y-8)
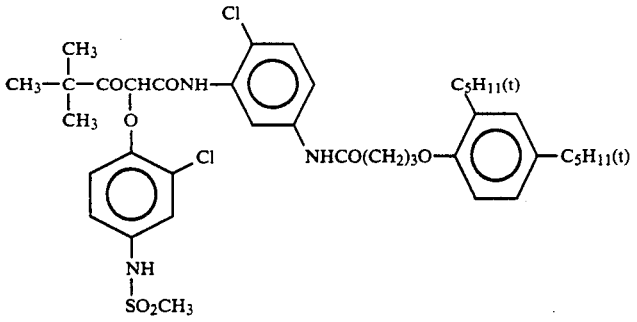
(Y-9)
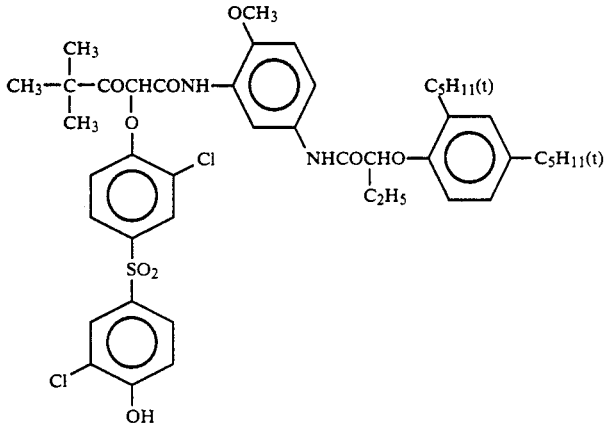
(Y-10)
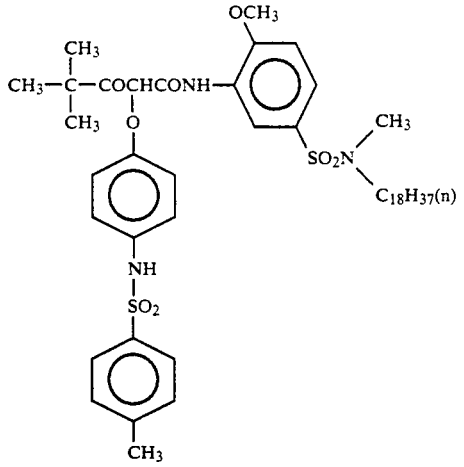
(Y-11)
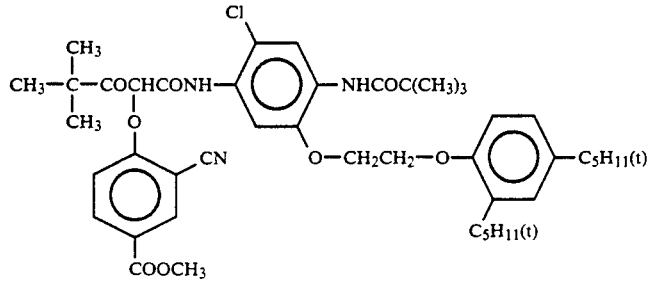

-continued
(Y-12)
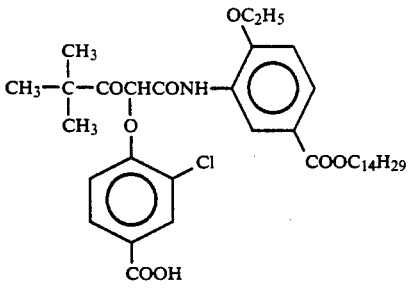
(Y-13)
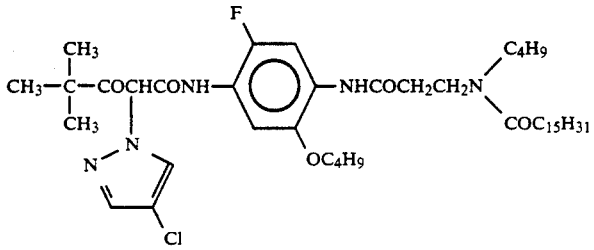
(Y-14)
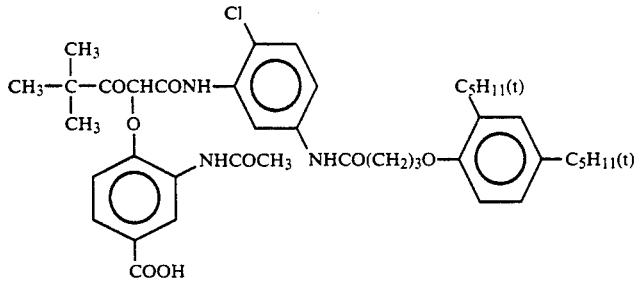
(Y-15)
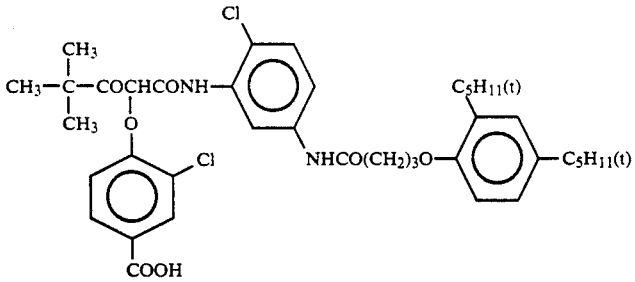
(Y-16)
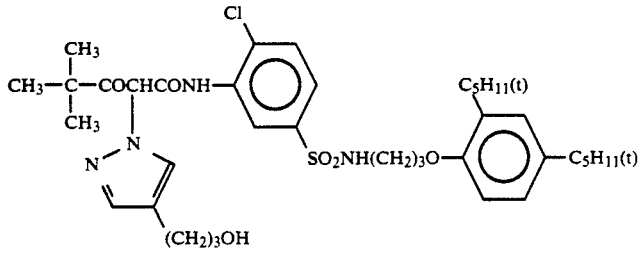

-continued
(Y-17)
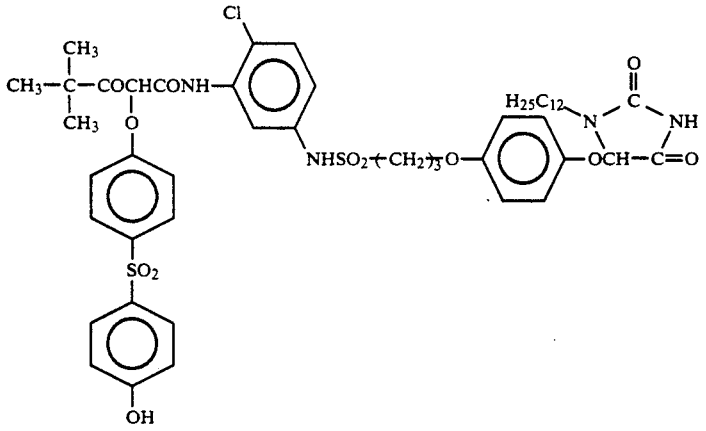
(Y-18)
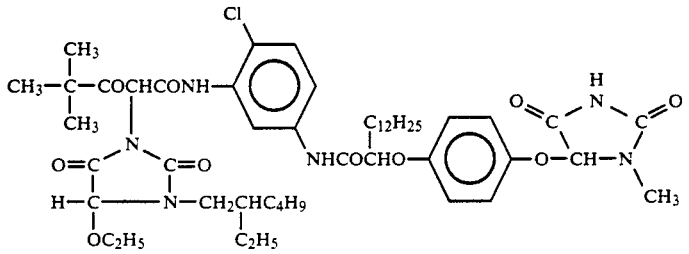
(Y-19)
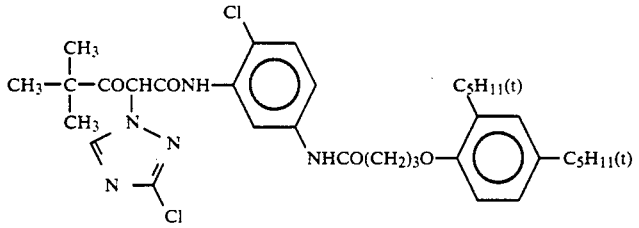
(Y-20)
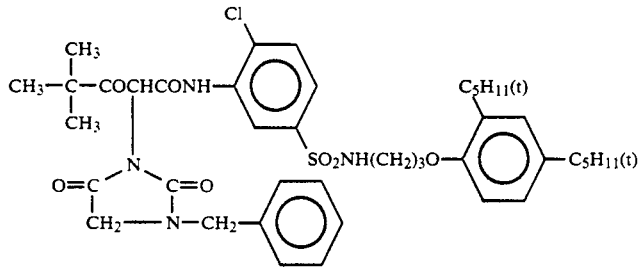
(Y-21)
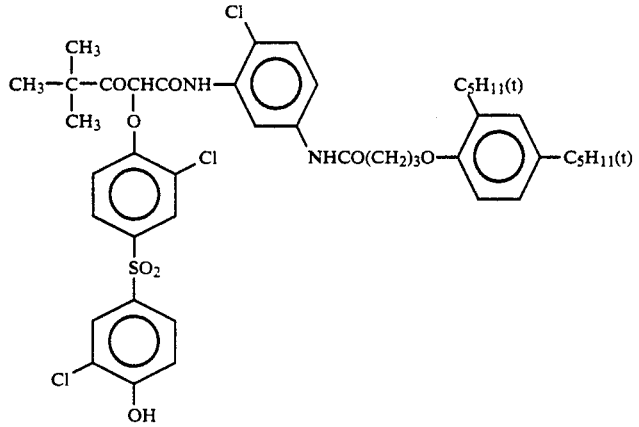

-continued
(Y-22)
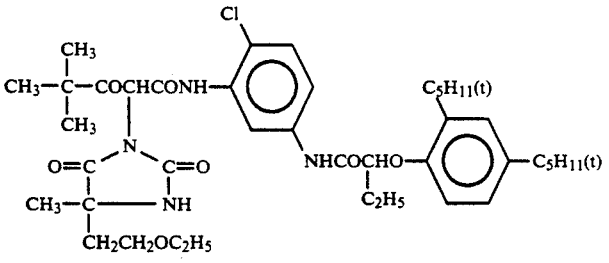
(Y-23)
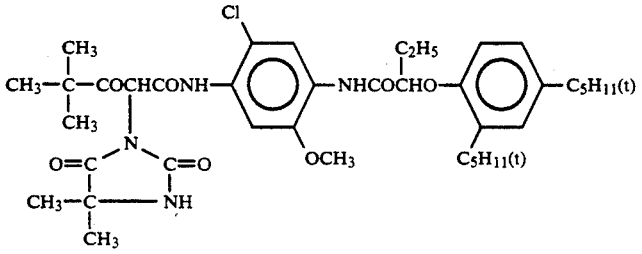
(Y-24)
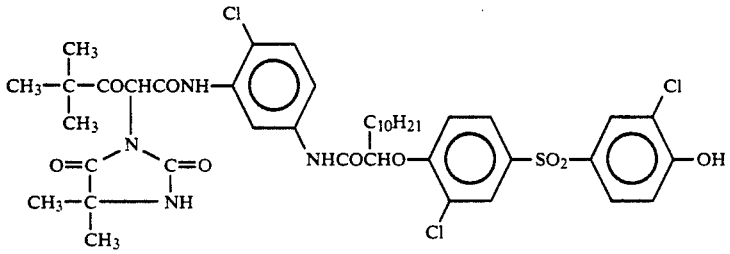
(Y-25)
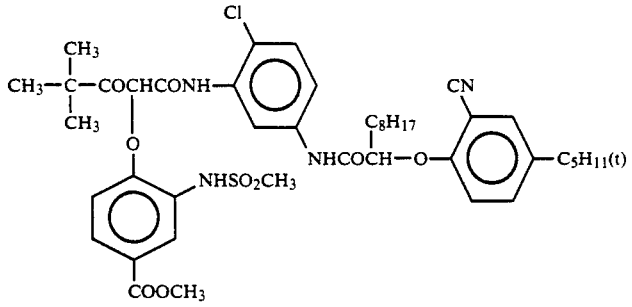
(Y-26)
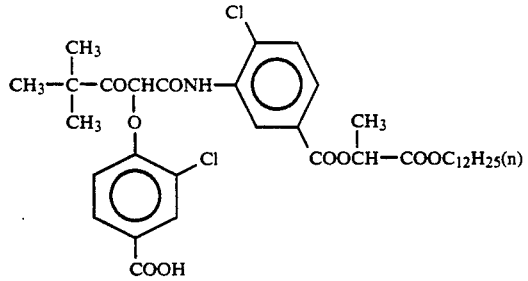
(Y-27)
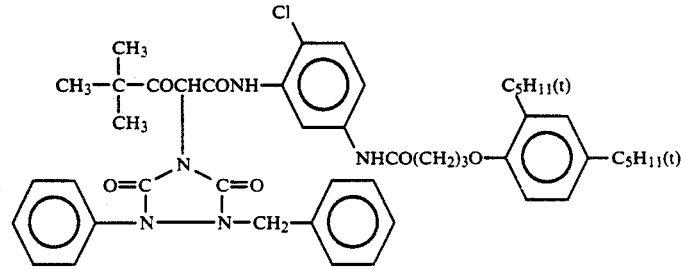

-continued
(Y-28)
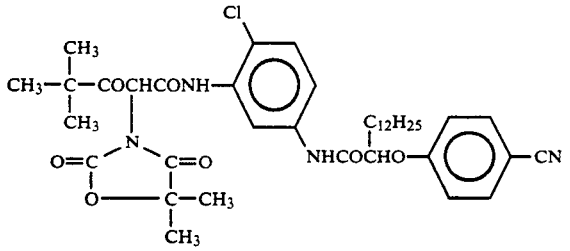
(Y-29)
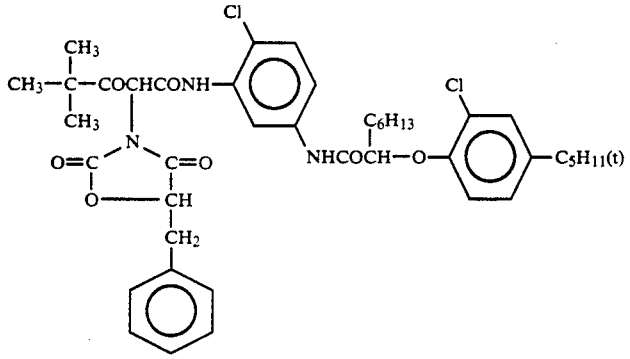
(Y-30)
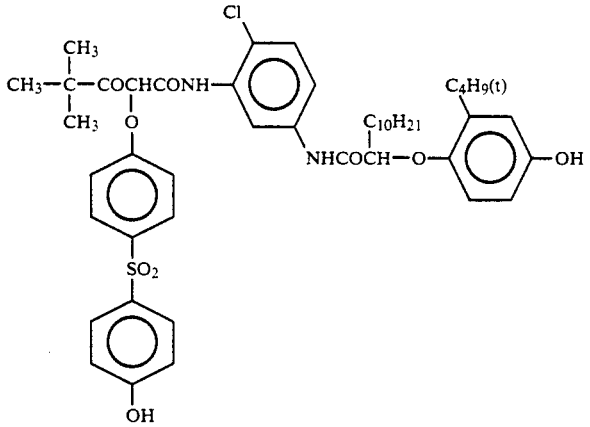
(Y-31)
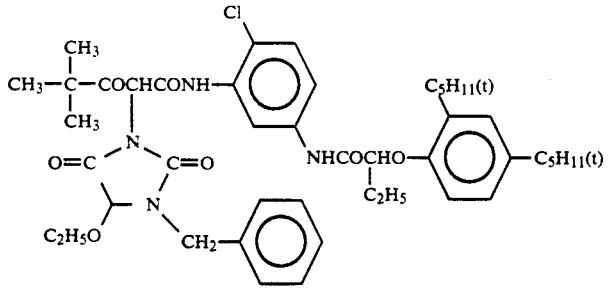
(Y-32)
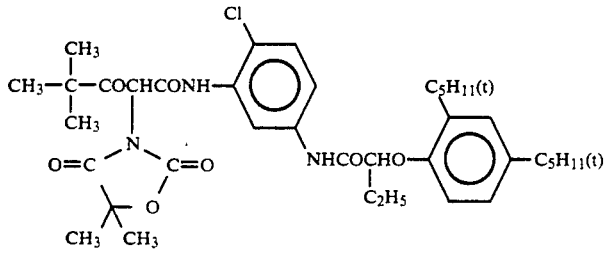

-continued (Y-33)

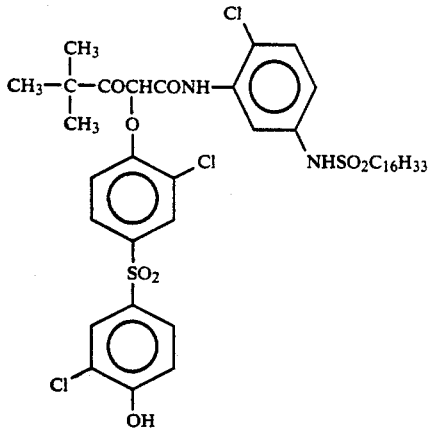

(Y-34)

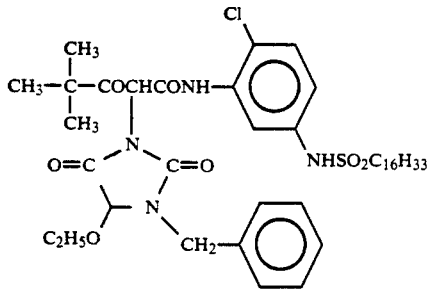

(Y-35)

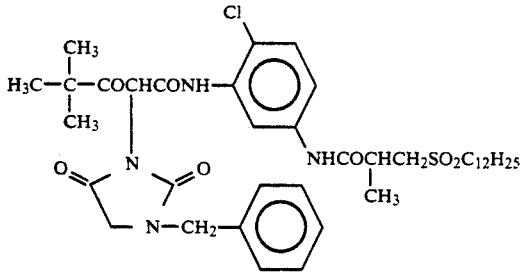

The coupler represented by formula (Y) is contained in the silver halide emulsion layer constituting the photosensitive layer, generally in an amount of 0.1 to 1.0 mol, preferably 0.1 to 0.5 mol, per mol of the silver halide.

The polymerization degree of said polymer for use in the present invention is preferably 100 to 5,000, more preferably 200 to 2,000. Although said polymers used in the present invention have no particular restriction as to the molecular weight, preferably they have a molecular weight of 1,000 to 50,000. When vinyl alcohol or vinyl pyrrolidone is used as a copolymer, as the compound to be copolymerized therewith, for example, an acrylate, acrylamide, ethyleneimine, vinylpyridine, styrene, vinylmethylimidazole, ionene, acryl, acrylic acid, methacrylic acid, maleic anhydride, maleic acid, styrenesulfonic acid, vinylbenzoic acid, phenol, polyestersilicon, vinylsuccinimide, acrylonitrile, a vinyl ester, an acrylic ester, vinyl alcohol, and vinyl pyrrolidone can be mentioned. The present invention is not restricted to these if the polymer composition contain 20 mol % or more of vinyl alcohol or vinyl pyrrolidone.

Preferably the copolymer contains 40 mol % or more of vinyl alcohol or vinyl pyrrolidone, more preferably 70 mol % or more of vinyl alcohol or vinyl pyrrolidone, and it is practically preferable that the copolymer is soluble in water so that, for example, it will dissolve uniformly.

Preferable specific examples of the polymer are listed below, but the present invention is not restricted to them.

A-1 polyvinyl alcohol
A-2 vinyl alcohol/vinyl acetate copolymer
A-3 vinyl alcohol/acrylic acid copolymer
A-4 vinyl alcohol/vinyl pyrrolidone copolymer
A-5 vinyl alcohol/methacrylic acid copolymer
A-6 vinyl alcohol/maleic acid copolymer
A-7 vinyl alcohol/acrylonitrile copolymer
A-8 vinyl alcohol/acrylate copolymer
A-9 vinyl alcohol/acrylate/acrylic acid copolymer
A-10 polyvinyl pyrrolidone
A-11 vinyl pyrrolidone/acrylate copolymer
A-12 vinyl pyrrolidone/vinyl acetate copolymer
A-13 vinyl pyrrolidone/methacrylic acid copolymer
A-14 vinyl pyrrolidone/maleic acid copolymer
A-15 vinyl pyrrolidone/acrylamide copolymer
A-16 vinyl pyrrolidone/methacrylamide copolymer
A-17 vinyl pyrrolidone/acrylic acid copolymer
A-18 vinyl pyrrolidone/acrylate/acryl copolymer
A-19 vinyl pyrrolidone/vinyl alcohol/acrylic acid copolymer A-20 vinyl pyrrolidone/vinyl alcohol/acrylate copolymer Preferably, the amount of the above compound to be added to the color developer is 0.05 to 2 g/l, and more preferably 0.1 to 1 g/l.

The present inventors have studied intensively for the purpose of preventing an increase in the yellow minimum density and streak-like processing streak with the progress of continuous processing and have attained the purpose by processing a silver halide photographic material containing a yellow coupler represented by formula (Y) with a color developer containing a homopolymer or a copolymer of vinyl alcohol or vinyl pyrrolidone.

Although the yellow coupler of the present invention represented by formula (Y) is described in JP-A No. 26133/1972, it cannot solve the above problems when the coupler is used simply.

Furthermore, when the above polymer of the present invention is simply used or is used with a yellow coupler falling outside the present invention, an antifogging effect or the like is not obtained at all.

The effect obtained by the combination of the above compounds is quite unique, it cannot be expected at all from the prior findings, and it is very surprising.

JP-B ("JP-B" means examined Japanese patent publication) No. 20743/1972 describes that the polymer of the present invention is added to a color developer. However, this publication intends to prevent a color-developing agent from crystallizing and depositing and does not describe at all the yellow coupler of formula (Y), the above problems in rapid processing, and the unique effect resulting from the combination of the polymer with the yellow coupler of the present invention, which cannot analogize the present invention.

The color developer used in the present invention will now be described below.

The color developer used in the present invention contains a known aromatic primary amine color-developing agent. Preferable examples are p-phenylenediamine derivatives and typical examples thereof are shown below, but the present invention is not restricted by them.

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]aniline
D-6: 4-amino-3-methyl-N-ethyl-N-[β-(methanesulfonamido)ethyl]-aniline
D-7: N-(2-amino-5-diethylaminophenylethyl)-methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) and 2-methyl-4-[N-ethyl-N-(β-hydroxyethyl)amino]-aniline (exemplified compound D-5) are particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 15 g, per liter of developer.

Various preservatives can be added into the color developer as needed.

Preferably, sulfite, bisulfite, unsubstituted hydroxylamine, substituted hydroxylamines, hydroxamic acids described in JP-A No. 43138/1988, hydrazines and hydrazides described in JP-A Nos. 146041/1988 and 170642/1988, phenols described in JP-A Nos. 44657/1988 and 58443/1988, α-hydroxyketones and α-aminoketones described in JP-A No. 44656/1988, and/or saccharides described in JP-A No. 36244/1988 are added. In combination with the above compounds monoamines described in JP-A Nos. 4235/1988, 24254/1988, 21647/1988, 146040/1988, 27841/1988, and 25654/1988, diamines described in JP-A Nos. 30845/1988, 146040/1988, and 43139/1988, polyamines described in JP-A Nos. 21647/1988 and 26655/1988, polyamines described in JP-A No. 44655/1988, nitroxy radicals described in JP-A No. 53551/1988, alcohols described in JP-A Nos. 43140/1988 and 53549/1988, oximes described in JP-A No. 56654/1988, and tertiary amines described in JP-A No. 239447/1988 are preferably used.

If necessary, various metals described in JP-A Nos. 44148/1982 and 53749/1982, salicylic acids described in JP-A No. 180588/1984, alkanolamines described in JP-A No. 3532/1979, polyethyleneimines described in JP-A No. 94349/1981, and aromatic polyhydroxyl compounds described in U.S. Pat. No. 3,746,544 may be contained as other preservatives. In particular, aromatic polyhydroxyl compounds are preferably added.

Compounds above-mentioned are added into the color developer in such amount that its concentration becomes to 0.005 to 0.5 mol/l, preferably 0.03 to 0.1 mol/l.

Among them, when a color photographic material of high-silver chloride content, such as 90 mol % or over is used, compounds represented by the following formulae (I) and (II) are preferably used as a preservative, in particular, in view of prevention of fogging and improvement of stability of color developer.

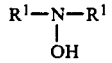

Formula (I)

wherein $R^1$ and $R^2$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom. The ring structure of the heterocyclic ring is a 5- to 6-membered ring, it is made up of carbon atoms, halogen atoms, oxygen atoms, nitrogen atom, sulfur atoms, etc., and it may be saturated or unsaturated.

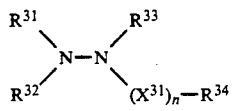

Formula (II)

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxyl group, a hydroxyamino group, a substituted or unsubstituted alkyl group, a substituted or unsubstituted aryl group, a substituted or unsubstituted heterocyclic group, a substituted or unsubstituted alkoxy group, a substituted or unsubstituted aryloxy group, a substituted or unsubstituted carbamolyl group, or a substituted or unsubstituted amino group. The heterocyclic group is a 5- or 6-membered ring made up of C, H, O, N, S, and/or a halogen atom, and it may be substituted or unsubstituted. $X^{31}$ represents a divalent group selected from —CO, —$SO_2$—, and —C—;

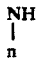

is 0 or 1, provided that when n=0, $R^{34}$ represents a group selected from an alkyl group, an aryl group, or a heterocyclic group. $R^{33}$ and $R^{34}$ may together form a heterocyclic ring.

In the color-developer according to the present invention, a compound represented by formulae (B-I) and (B-II) shown below is more preferably used in view of attainments of better effect of the present invention.

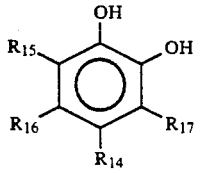

Formula (B-I)

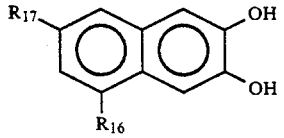

Formula (B-II)

wherein $R_{14}$, $R_{15}$, $R_{16}$, and $R_{17}$, each represent a hydrogen atom, a halogen atom, a sulfonic group, an alkyl group having 1 to 7 carbon atoms, —$OR_{18}$, —$COOR_{19}$,

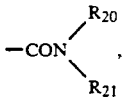

or phenyl group; and $R_{18}$, $R_{19}$, $R_{20}$, and $R_{21}$ each represent a hydrogen atom, an alkyl group having 1 to 18 carbon atoms, provided that when $R_{15}$ represents —OH or a hydrogen atom, $R_{14}$ represents a halogen atom, sulfonic group, an alkyl group having 1 to 7 carbon atoms, —$OR_{18}$, —$COOR_{19}$,

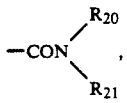

or a phenyl group.

Alkyl group represented by the above-described $R_{14}$, $R_{15}$, $R_{16}$, and $R_{17}$ include those having a substituent, and examples thereof that can be mentioned include, for example, methyl group, ethyl group, iso-propyl group, n-propyl group, t-butyl group, n-butyl group, hydroxymethyl group, hydroxyethyl group, methylcarbonic acid group, and benzyl group. Alkyl group represented by $R_{18}$, $R_{19}$, $R_{20}$, and $R_{21}$, has the same meaning as the above and further octyl group can be included.

As phenyl group represented by $R_{14}$, $R_{15}$, $R_{16}$, and $R_{17}$ phenyl group, 2-hydroxyphenyl group, and 4-amino-phenyl group can be mentioned.

Representative examples of the chelating agent of the preset invention are shown below, but the invention is not limited to them.

(B-I-1): 4-isopropyl-1,2-dihydroxybenzene
(B-I-2): 1,2-dihydroxybenzene-3,5-disulfonic acid
(B-I-3): 1,2,3-trihydroxybenzene-5-carbonic acid
(B-I-4): 1,2,3-trihydroxybenzene-5-carboxymethyl ester
(B-I-5): 1,2,3-trihydroxybenzene-5-carboxy-n-butyl ester
(B-I-6): 5-t-butyl-1,2,3-trihydroxybenzene
(B-I-7): 1,2-dihydroxybenzene-3,4,6-trisulfonic acid
(B-II-1): 2,3-dihydroxynaphthalene-6-sulfonic acid
(B-II-2): 2,3,8-trihydroxynaphthalene-6-sulfonic acid
(B-II-3): 2,3-dihydroxynaphthalene-6-carbonic acid
(B-II-4): 2,3-dihydroxy-8-isopropyl-naphthalene
(B-II-5): 2,3-dihydroxy-8-chloro-naphthalene-6-sulfonic acid Of the above-mentioned compounds, one that can be used preferably in particular in the present invention is 1,2-dihydroxybenzene-3,5-disulfonic acid, which may be used as the form of alkaline salt such as sodium salt and potassium salt (exemplified compound (B-I-2)).

In the present invention, compound represented by the above formulae (B-I) or (B-II) may be used in the range of 5 mg to 15 g, preferably 15 mg to 10 g, more preferably 25 mg to 7 g, per liter of color developer.

Preferably the pH of the color developer of the present invention is in the range of 9 to 12, more preferably 9 to 11.0, and other known compounds that are components of a conventional developing solution can be contained.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer.

Specific examples are shown below, but the present invention is not limited to them: nitrilotriacetic acid, diethylenediaminepentaacetic acid, ethylenediaminetetraacetic acid, triethylenetetraminehexaacetic acid, nitrilo-N,N,N-tris(methylenephosphonic acid), ethylenediamine-N,N,N',N'-tetrakis(methylenesulfonic acid), 1,3-diamino-2-propanoltetraacetic acid, transcyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamine-ortho-hydroxyphenyltetraacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

Of these chelating agents, ethylendiaminetetraacetic acid, diethyleneditriaminepentaacetic acid, triethylenetetraminehexaacetic acid, 1-3-diamino-2-propanoltetraacetic acid, ethylenediamine-N,N,N',N'-tetrakis(methylenephosphonic acid), and hydroxyiminodiacetic acid are preferably used.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; p-aminophenols disclosed, for example, in U.S. Pat. Nos. 2,610,122 and 4,119,462; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, mesoionic type compounds, ionic type compounds, and imidazoles.

It is preferable that the color developer of the present invention is substantially free from benzyl alcohol in view of prevention of edge stain. Herein the term "substantially free from" means that the amount of benzyl alcohol is 2.0 ml or below per liter of the developer, or preferably benzyl alcohol is not contained in the developer at all. It is particularly preferable to be substantially free from benzyl alcohol in view of prevention of edge stain.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

In the present invention, effects of the combined use of the above-mentioned coupler and polymer can be exhibited remarkably when a color photographic material (e.g., for color print) comprising a high-silver chloride emulsion is processed. Herein, when a color photographic material comprising 80 mol % or over of high-silver chloride emulsion is processed for development, preferably concentrations of chloride ions and bromide ions in color developer are $3\times10^{-2}$ to $1.5\times10^{-1}$ mol/l and $3\times10^{-5}$ to $1\times10^{-3}$ mol/l, respectively, in view of the prevention of fogging and processing stability.

It is preferable that the color developer used in the present invention contains a brightening agent. As the brightening agent, 4,4'-diamino-2,2'-disulfostilbene compounds are preferable, which will be added in an amount of 0 to 10 g/l, preferably 0.1 to 6 g/l.

If required, various surface-active agents, such as alkylsulfonic acids, arylphosphonic acids, aliphatic carboxylic acids, and aromatic carboxylic acids may be added.

The processing time with the color developer for use in the present invention may be, for example, 10 to 120 sec., preferably 20 to 60 sec., in which effects of the present invention being remarkable. Further, the processing time of 20 to 35 sec. is particularly preferable in view of prevention of processing streak. The processing temperature may be 33° to 45° C., and preferably 36° to 40° C., under such conditions the effect of the present invention is particularly remarkable.

Further, the percent ratio of crossover time (the time after the sample to be processed comes out of a color developer till it comes into a successive bleach-fixing solution) to color developing time (the time after the top end of the sample enters the color developer till it enters the bleach-fixing solution) is preferably 3 to 25%, more preferably 5 to 20%, in the present invention.

The amount of the replenisher of the color developer during continuous processing is 20 to 350 ml, preferably 25 to 160 ml, and particularly preferably 30 to 110 ml, per 1 $m^2$ of the photographic material, which is preferable because the effect of the present invention can be exhibited efficiently.

The color developer of the present invention has relatively better performance than that obtained by combinations other than the combination of the present invention, even if the opened surface ratio of the color developer (the air contact surface area ($cm^2$)/the solution volume ($cm^3$)) is in any state. Preferably the opened surface ratio is 0 to 0.1 $cm^{-1}$ in view of the stability of the color developer. In the continuous processing, preferably, in practice, the opened surface ratio is in the range of 0.001 to 0.05 $cm^{-1}$, more preferably 0.002 to 0.03 $cm^{-1}$.

Generally when hydroxylamine or the like is used as a preservative, it is widely known that even if the liquid opening rate of the color developer is made small, decomposition of the color developer due to heat or trace metals takes place. However, in the color developer of the present invention, such decomposition is very little, and the color developer can be stored for a long period of time or can practically be well used continuously for a long period of time without difficulty. Therefore, in such a case, preferably the opened surface ratio is smaller, and most preferably the opened surface ratio is 0 to 0.002 $cm^{-1}$.

Conversely, there is a method wherein a large opened surface ratio is used, provided that after a certain amount of a photographic material is processed, the processing solution is discarded, and even in such a processing method, the constitution according to the present invention can exhibit excellent performance.

In the present invention desilvering is effected after color development. The desilvering step generally consists of a bleaching step and a fixing step, and particularly preferably the bleaching step and the fixing step are carried out simultaneously.

Further, the bleaching solution or the bleach-fixing solution used in the present invention can contain rehalogenation agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contain, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the fixing solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanediol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol.

The pH range of the bleach-fixing solution or the fixing solution is preferably 3 to 8, and particularly preferably 4 to 7. If the pH is lower than this range, the desilvering is improved, but the deterioration of the solution and the changing to leuco dye of cyan dye are accelerated. In reverse, if the pH is higher than this range, the desilvering is retarded and stain is liable to occur.

Further, it is preferable in the present invention in view of preventing the occurrence of processing streak when the pH of the bleach-fixing solution is 4.5 to 6.5, more preferably when the pH is 5 to 6.

To adjust pH, if necessary, a compound such as hydrochloric acid, sulfuric acid, nitric acid, acetic acid, bicarbonate, ammonia, caustic potassium, caustic soda, sodium carbonate and potassium carbonate may be added.

Further, the bleach-fixing solution may additionally contain various brightening agents, anti-foaming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, sulfinic acid, sulfinic acid, or carbonyl compounds, may be added.

If required, for example, buffers, brightening agents, chelating agents, and mildew-proofing agents may be added.

The processing time by the bleach-fixing solution of the present invention is in the range of 10 to 120 sec., preferably 20 to 60 sec., and the replenishing amount of the bleach-fixing solution is in the rage of 30 to 3,500 ml, preferably 40 to 150 ml, per square meter of photographic material. While it is generally liable to increase stain and occur an insufficient desilvering accompanying with the decrease of replenishing amount, the decrease of replenishing amount without these problems can be made according to the present invention.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955).

According to the multi-stage countercurrent system, the amount of washing water can be reduced considerably. But a problem arises that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 288838/1987 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Mekkin, Sakkin, Bobai Gijutsu* (edited by Eiseigijutsu-kai), and *Bokin Bobai-zai Jiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 2 min., preferably 25° to 40° C. and 30 sec. to 1 min.

According to the present invention good photographic properties without the increasing of stain can be obtained even if processing by such short-time washing.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

The time of the processing steps of the present invention is defined as the period from the time when the photographic material is brought in contact with the color developer to the time when the photographic material leaves the final bath (which is generally a washing bath or a stabilizing bath), and the effect of the present invention can be exhibited remarkably in rapid processing steps wherein the time of those processing steps is 3 min 30 sec or below, preferably 3 min or below.

Now the color photographic material to be used in the present invention will be described in detail.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As a silver halide contained in the photographic emulsion layer of the photographic material to be used in the present invention can be used any of silver chloride, silver bromide, silver chlorobromide, silver iodobromide, silver chloroiodobromide, and silver iodobromide.

In a rapid processing or a low-amount replenisher processing, silver chlorobromide comprising 80 mol % or more of silver chloride and being substantially free from silver iodide can be preferably used. Herein the term "substantially free from silver iodide" means that the silver iodide content is 1 mol % or below, and preferably 0.2 mol % or below.

Further, the silver halide content is preferably 90 mol % or more, particularly preferably 95 mol % or more. In order to reduce the replenishing amount of the development processing solution, to increase the silver chloride content further is preferably practiced. In such a case, an emulsion whose silver chloride is almost pure that is, whose silver chloride content is 98 to 99.9 mol %, is also preferably used. However, when really pure silver chloride is used, there are disadvantages in view of attainment of high sensitivity and preventing the fogging occurred when pressure applied.

Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, in view of better exhibition of effects of the present invention, in the case of high-silver-chloride emulsions having a silver chloride content of 90 mol % or over, it is preferably also practiced to use grains having a uniform-type structure, wherein the distribution of the halogen composition in the grain is small.

The coating amount of silver halide emulsion in terms of silver is preferably 0.75 g or less per $m^2$ of photographic material in view of rapid processing and prevention of fluctuation in processing. In particular, it is preferable 0.70 g or less, more preferable 0.65 g or less, per $m^2$ of photographic material. Further, 0.4 g or more is preferably in view of image density.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tubular grains having an average aspect ratio (the diameter of a circle calculated/the thickness) of 5 or over, and preferably 8 or over, exceed 50% of the total of the grains in terms of the projected area, can be preferably used.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-I), (C-II), (M-I), and (M-II).

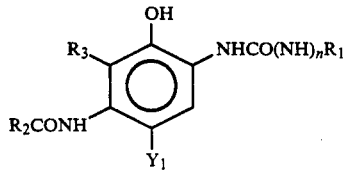

Formula (C-I)

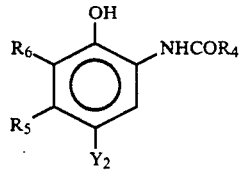

Formula (C-II)

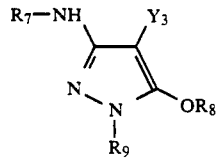

Formula (M-I)

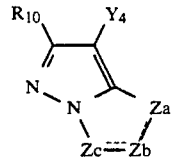

Formula (M-II)

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tertbutyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a group capable being released upon coupling reaction. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a group capable being released upon coupling reaction, and particularly preferably a halogen atom or an arylthio group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

Among them, the use of magenta coupler represented by (M-II) is preferable in view of preventing the streak-like fogging when the replenishing amount is reduced in a continuous processing. This is a effect to be able to attain, for the first time, by a combined use of the coupler and said polymer of the present invention. A combined use of three kind of compounds, that is, said polymer, a yellow coupler represented by formula (Y), and magenta coupler represented by formula (M-II) exhibits most remarkable effect.

Specific examples of coupler represented by formula (M-II) are shown below, but the invention is not limited by them.

| Compound | $R_{10}$ | $R_{15}$ | $Y_4$ |
|---|---|---|---|
| | | 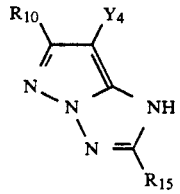 | |
| M-1 | $CH_3$— | 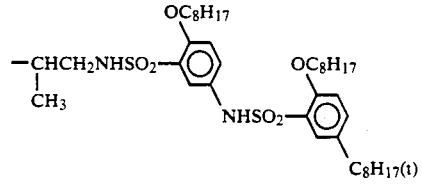 | Cl |

-continued
| Compound | $R_{10}$ | $R_{15}$ | $Y_4$ |
|---|---|---|---|
| M-2 | The same as the above | 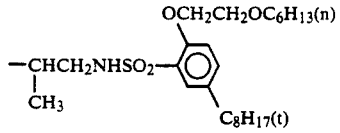 | The same as the above |
| M-3 | $(CH_3)_3C-$ | 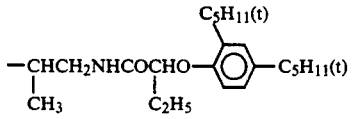 | 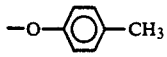 |
| M-4 | 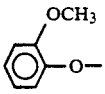 | 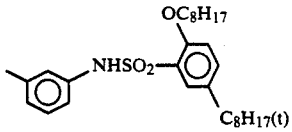 | 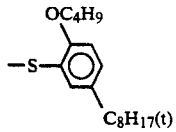 |
| M-5 | $CH_3-$ | 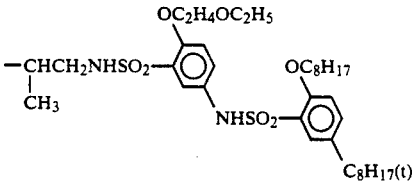 | Cl |
| M-6 | The same as the above | 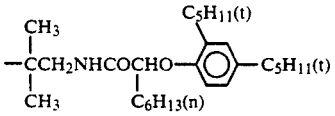 | The same as the above |
| M-7 | The same as the above | 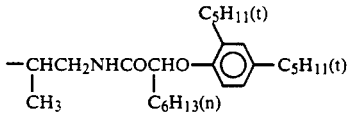 | The same as the above |
| M-8 | The same as the above | 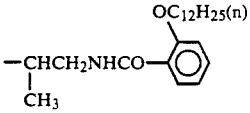 | The same as the above |
| M-9 | $CH_3-$ | 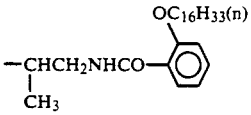 | Cl |
| M-10 | 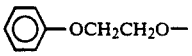 | 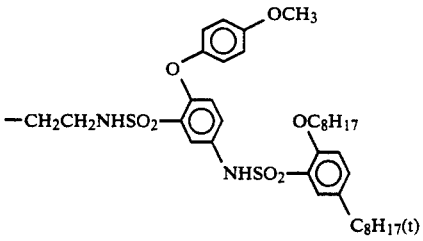 | 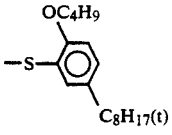 |
| M-11 | $CH_3CH_2O-$ | The same as the above | The same as the above |
| M-12 | 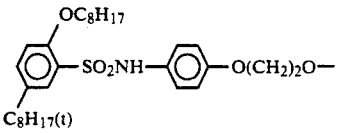 | 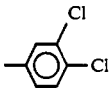 | 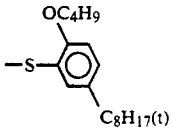 |

-continued
| Compound | $R_{10}$ | $R_{15}$ | $Y_4$ |
|---|---|---|---|
| M-13 | 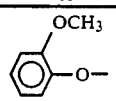 | 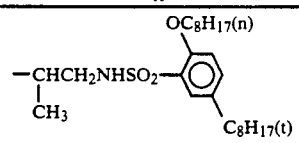 | Cl |
| | | 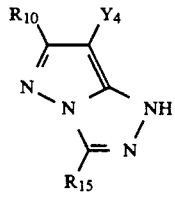 | |
| M-14 | $CH_3$— | 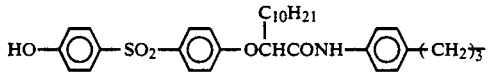 | Cl |
| M-15 | The same as the above | 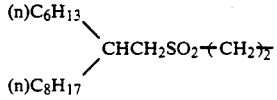 | The same as the above |
| M-16 | 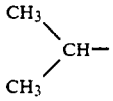 | 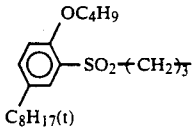 | Cl |
| M-17 | 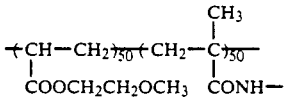 | 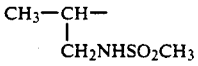 | The same as the above |
| M-18 | 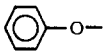 | 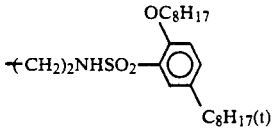 | The same as the above |
| M-19 | $CH_3$— | 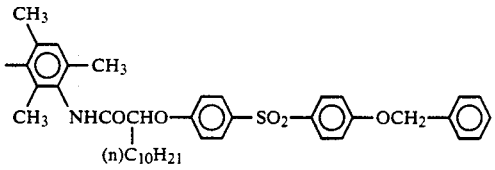 | Cl |
| M-20 | $(CH_3)_3C$— | 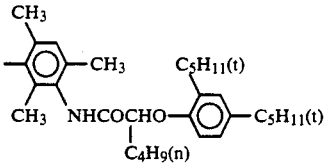 | The same as the above |
| M-21 | 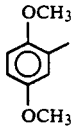 | 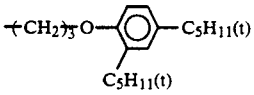 | The same as the above |
| M-22 | $CH_3$— | 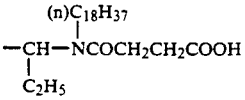 | The same as the above |
The couplers represented by formulae (Y) to (M-II) are contained in the silver halide emulsion layer consti- In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

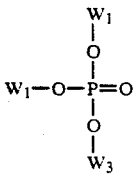
Formula (A')

$W_1-COO-W_2$ Formula (B')

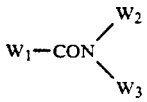
Formula (C')

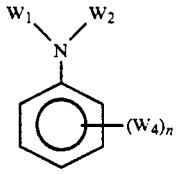
Formula (D')

$W_1-O-W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. Nos. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol·sec to $1\times10^{-5}$ l/mol·sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_1-(A_1)_n-X \qquad \text{Fromula (FI)}$$

$$R_2-\underset{\underset{B_1}{|}}{C}=Y \qquad \text{Formula (FII)}$$

wherein $R_1$ and $R_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_1$ and X, or Y and $R_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_3-Z \qquad \text{Formula (GI)}$$

wherein $R_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i-\overline{R})^2}{n-1}} \Big/ \frac{\sum_{i=1}^{n} Ri}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

According to the present invention, yellow stain and processing streaks involved in a running processing can be prevented effectively by using a pivaloyl-type yellow coupler represented by formula (Y) and by incorporating a specific polymer in a color developer.

With respect to the above problem, which takes place particularly remarkably when a photographic material uses a high-silver-chloride emulsion and is subjected to rapid processing, the combination of the above coupler and the above polymer is effective.

Next, the present invention will be described in detail in accordance with examples, but the invention is not limited to these Examples.

EXAMPLE 1

A multilayer color photographic paper was prepared by coating layers as hereinbelow described on a paper laminated on both sides with polyethylene film and subjected to surface corona discharge treatment. Coating solutions were prepared as follows:

Preparation of the first-layer coating solution

To a mixture of 60.0 g of yellow coupler (ExY) and 28.0 g of discoloration inhibitor (Cpd-1), 150 ml of ethyl acetate, 1.0 ml of solvent (Solv-3) and 3.0 ml of solvent (Solv-4) were added and dissolved. The resulting solution was added to 450 ml of 10% aqueous gelatin solution containing sodium dodecylbenzene-sulfonate, and then the mixture was dispersed by a supersonic homogenizer. The resulting dispersion was mixed with and dissolved in 420 g of silver chlorobromide emulsion (silver bromide: 0.7 mol %) containing a blue-sensitive sensitizing dye, described below, to prepare the first-layer coating solution.

Coating solutions for the second to seventh layers were also prepared in the same manner as in the first layer coating solution. As a gelatin hardener for the respective layers, 1,2-bis(vinylsulfonyl)ethane was used.

As spectral sensitizers for the respective layers, the following compounds were used:

Blue-sensitive emulsion layer:

Anhydro-5,5-dichloro-3,3-disulfoethylthia-cyanine hydroxide

Green-sensitive emulsion layer:

Anhydro-9-ethyl-5,5-diphenyl-3,3-disulfoethylox-acarbocyanine hydroxide

Red-sensitive emulsion layer:

3,3-Diethyl-5-methoxy-9,11-neopentyl-thiadicarbocyanine iodide

As a stabilizer for the respective emulsion layer, a mixture (7:2:1 in molar ratio) of the following compounds was used:

1-(2-Acetoaminophenyl)-5-mercaptotetrazole,
1-Phenyl-5-mercaptotetrazole, and
1-(p-Methoxyphenyl)-5-mercaptotetrazole As irradiation preventing dyes the following compounds were used:

[3-Carboxy-5-hydroxy-4-(3-(3-carboxy-5-oxo-1-(2,5-sulfonatophenyl)-2-pyrazoline-4-iridene)-1-propenyl)-1-pyrazolyl]benzene-2,5-disulfonatedisodium salt, N,N'-(4,8-Dihydroxy-9,10-dioxo-3,7-disolfonatoanthracene-1,5-diyl)bis(aminomethanesulfonato)tetrasodium salt, and

[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonato-sodium salt Composition of layers The composition of each layer is shown below. The figures represent coating amounts (g/m$^2$). The coating amounts of each silver halide emulsion is represented in terms of silver.

Base:

Paper support laminated on both sides with polyethylene film and subjected to surface corona discharge treatment

| | |
|---|---|
| First Layer (Blue-sensitive emulsion layer): | |
| The above-described silver chlorobromide emulsion (AgBr: 0.7 mol %, cubic grain, average grain size: 1.02 μm) | 0.25 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| Second Layer (Color-mix preventing layer): | |
| Gelatin | 0.80 |
| Color-mix inhibitor (Cpd-2) | 0.055 |
| Solvent (Solv-1) | 0.03 |
| Solvent (Solv-2) | 0.15 |
| Third Layer (Green-sensitive emulsion layer): | |
| The above-described silver chlorobromide emulsion (AgBr: 0.7 mol %, cubic grain, average grain size: 0.58 μm) | 0.13 |
| Gelatin | 1.86 |
| Magenta coupler (ExM) | 0.20 |
| Discoloration inhibitor (Cpd-3) | 0.17 |
| Discoloration inhibitor (Cpd-4) | 0.10 |
| Solvent (Solv-1) | 0.2 |
| Solvent (Solv-2) | 0.03 |
| Fourth Layer (Color-mix preventing layer): | |
| Gelatin | 1.70 |
| Color-mix inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth Layer (Red-sensitive emulsion layer): | |
| The above-described silver chlorobromide emulsion (AgBr: 4 mol %, cubic grain, average grain size: 0.59 μm) | 0.21 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color-forming accelerator (Cpd-5) | 0.15 |
| Sixth Layer (Ultraviolet light absorbing layer) | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| Seventh Layer (Protective layer) | |
| Gelatin | 1.07 |

Compounds used are as follows:

(ExY) Yellow coupler: Y-35
(ExM) Magenta coupler: M-16
(ExC-1) Cyan coupler

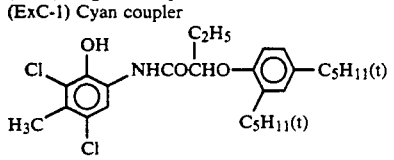

(ExC-2) Cyan coupler

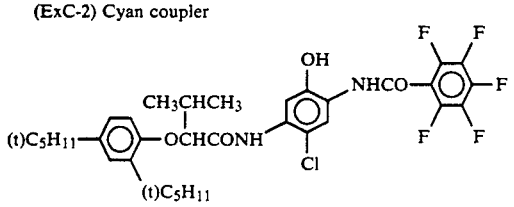

(Cpd-1) Discoloration inhibitor

-continued $$\left(CH_2-\underset{\substack{|\\ CONHC_4H_9(n)}}{CH}\right)_n$$

Average molecular weight: 80,000

(Cpd-2) Color-mix inhibitor
2,5-Di-tert-octylhydroquinone
(Cpd-3) Discoloration inhibitor
7,7'-dihydroxy-4,4,4',4'-tetramethyl-2,2'-spirocumarone
(Cpd-4) Discoloration inhibitor
N-(4-dodecyloxyphenyl)-morpholine
(Cpd-5) Color-forming accelerator
p-(p-Toluenesulfonamido)phenyl-dodecane
(Solv-1) Solvent
Di(2-ethylhexyl)phthalate
(Solv-2) Solvent
Dibutylphthalate
(Solv-3) Solvent
Di(i-nonyl)phthalate
(Solv-4) Solvent
N,N-diethylcarbonamido-methoxy-2,4-di-t-amylbenzene
(UV-1) Ultraviolet absorber
2-(2-Hydroxy-3,5-di-tert-amylphenyl)benzotriazole
(UV-2) Ultraviolet absorber
2-(2-Hydroxy-3,5-di-tert-butylphenyl)benzotriazole The thus-prepared sample was designated as 101.

Samples 102 to 108 were prepared in the same manner as sample 101, except that the yellow coupler was changed as shown in Table 1, provided the coating amount being equimolar amount.

The above samples were exposed imagewise to light and subjected to a continuous processing (running test) through the following steps by using a paper processor until a volume of color developer twice that of a tank had been replenished.

The composition of color developer was changed as shown in Table 1.

| Processing step | Temperature | Time | Replenisher Amount* | Tank Volume |
|---|---|---|---|---|
| Color developing | 38° C. | 45 sec. | 65 ml | 4 l |
| Bleach-fixing | 30–36° C. | 45 sec. | 215 ml | 4 l |
| Stabilizing (1) | 30–37° C. | 20 sec. | — | 2 l |
| Stabilizing (2) | 30–37° C. | 20 sec. | — | 2 l |
| Stabilizing (3) | 30–37° C. | 20 sec. | 364 ml | 2 l |
| Drying | 70–85° C. | 60 sec. | | |

Note: *Replenisher amount per 1 $m^2$ of photographic material
The stabilizing steps were carried out in a 3-tanks counter-current flowing system from the tank of stabilizing (3) toward the tank of stabilizing (1).

Compositions of the respective processing solution were as follows:

| | Tank solution | Replenisher |
|---|---|---|
| Color developer | | |
| Water | 800 ml | 800 ml |
| Additive (See Table 1) | 0.2 g | 0.2 g |
| Ethylenediaminetetraphophnic acid | 9.4 g | 9.4 g |
| Diethylenetriamineheptaacetic acid | 3.0 g | 3.0 g |
| Triethanolamine | 11.6 g | 11.6 g |
| Potassium chloride | 5.0 g | — |
| Potassium bromide | 0.02 g | — |
| Potassium carbonate | 25 g | 25 g |
| N-ethyl-N-(β-methanesulfon- | 5.0 g | 12.0 g |

-continued

| | Tank solution | Replenisher |
|---|---|---|
| amidoethyl)-3-methyl-4-aminoaniline sulfate | | |
| Hydrazinodiacetic acid | 0.04 mol | 0.06 mol |
| Sodium sulfite | 0.1 g | 0.2 g |
| Fluorescent brightening agent (WHITEX-4, manufactured by Sunitomo Chemical Ind. Co.) | 1.0 g | 3.5 g |
| Water to make | 1000 ml | 1000 ml |
| pH (25° C.) | 10.00 | 10.80 |
| Bleach-fixing solution (both tank solution and replenisher) | | |
| Water | 400 ml | |
| Ammonium thiosulfate (70%) | 100 ml | |
| Sodium sulfite | 17 g | |
| Iron (III) ammonium ethylenediaminetetraacetate | 55 g | |
| Disodium ethylenediaminetetraacetate | 5 g | |
| Glacial acetic acid | 9 g | |
| Water to make | 1000 ml | |
| pH (25° C.) | 5.40 | |
| Stabilizing solution (both tank solution and replenisher) | | |
| Formalin (37%) | 0.1 g | |
| Formalin-sulfic acid adduct | 0.7 g | |
| 5-Chloro-2-methyl-4-isothiazoline-3-one | 0.02 g | |
| 2-Methyl-4-isothiazoline-3-one | 0.01 g | |
| Copper sulfate | 0.005 g | |
| Water to make | 1000 ml | |
| pH (25° C.) | 4.0 | |

Coated samples were given gradation exposure to light for sensitometry using a sensitometer (FWH model, manufactured by Fuji Photo Film Co., Ltd.; the color temperature of the light source: 3200 K). At that time, exposure was effected such that the exposure time was 1/10 second and the exposure amount was 250 CMS.

At the start of the running test and after the completion of the running test, said sensitometry was processed, the yellow minimum density was measured by a Macbeth densitometer, and the inarease in the yellow minimum density that resulted from the running was evaluated. The results are shown in Table 1.

After the running was completed, the coated samples were subjected to gray exposure to light so that the density might be 0.5 and they were processed and the streak-like processing streak was evaluated. The results are shown in Table 1.

TABLE 1

| Experiment No. | Coated Sample | Yellow Coupler | Additive | Yellow ΔDmin | Processing Streak | Remarks |
|---|---|---|---|---|---|---|
| 1 | 101 | Y-35 | — | +0.04 | X | Comparative Example |
| 2 | 102 | Y-31 | — | +0.03 | X | Comparative Example |
| 3 | 103 | RY-1 | — | +0.05 | X | Comparative Example |
| 4 | 103 | RY-1 | A-10 | +0.05 | X | Comparative Example |
| 5 | 104 | RY-2 | — | +0.04 | X | Comparative Example |
| 6 | 104 | RY-2 | A-10 | +0.05 | X | Comparative Example |
| 7 | 105 | RY-3 | A-10 | +0.05 | X | Comparative Example |
| 8 | 101 | Y-35 | A-10 | +0.01 | ○ | This Invention |
| 9 | 101 | Y-35 | A-1 | +0.01 | Δ | This Invention |
| 10 | 101 | Y-35 | A-17 | +0.01 | ○ | This Invention |
| 11 | 101 | Y-35 | A-9 | ±0 | ○ | This Invention |
| 12 | 102 | Y-31 | A-9 | +0.01 | ○ | This Invention |
| 13 | 102 | Y-32 | A-9 | ±0 | ○ | This Invention |
| 14 | 102 | Y-20 | A-9 | ±0 | ○ | This Invention |
| 15 | 102 | Y-34 | A-9 | +0.01 | ○ | This Invention |

Note: Criterion of evaluation for processing streak
○: Absence of streak
Δ: A little of streak (not remarkable)
X: Many streak (very remarkable)

Compounds used are as follows:

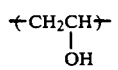
(A-1)

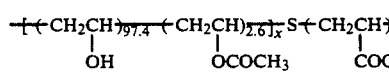
x:y = 9:1 (in weight ratio)
(A-9)

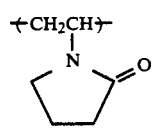
(A-10)

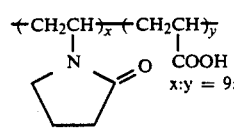
x:y = 9:1 (in weight ratio)
(A-17)

-continued

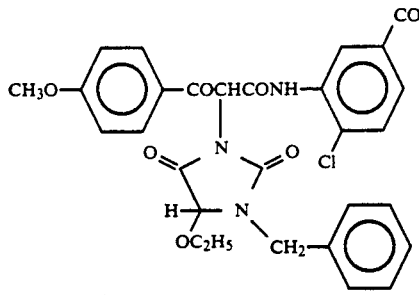

(RY-1)

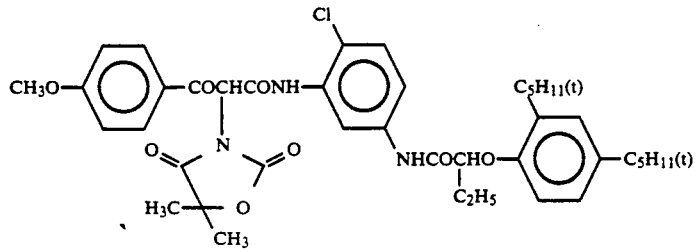

(RY-2)

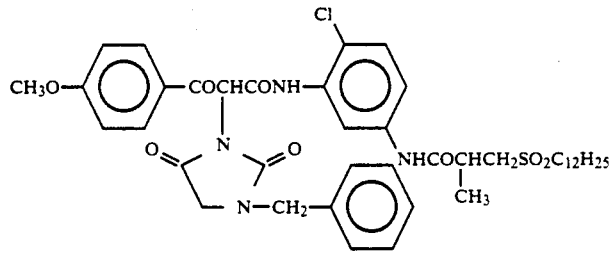

(RY-3)

As is apparent from the results in Table 1, when the constituent features of the present invention were satisfied, an increase of the yellow minimum density and the occurrence of processing streak with the progress of running processing were remarkably prevented, and therefore the objects of the present invention could be attained (Experiment Nos. 8 to 15).

When photographic material not containing the yellow coupler of the present invention was processed, an increase of the yellow minimum density and processing streak with the progress of running occurred irrespective of the presence or absence of the polymer of the present invention in the color developer, and therefore the objects of the present invention could not be attained (Experiment Nos. 3 to 7).

When the polymer of the present invention was not contained in the color developer, an increase of the yellow minimum density and processing streak with the progress of running occurred irrespective of whether a yellow coupler that fell within the scope of the present invention or not, and therefore the objects of the present invention could not be attained (Experiment Nos. 1 to 3 and 5).

Thus, when the constituents features of the present invention are satisfied simultaneously, the effect of the present invention is exhibited and the uniqueness of the combination of the constituent features of the present invention can be understood.

When Experiment No. 1 and Experiment No. 8 are compared, the density difference in the increase of the yellow minimum density is 0.03, which is a very low value, but when the non-color developed portions of them are compared visually, the whiteness is clearly different. An increase of minimum density of 0.03 or more falls in the range where a practical problem arises, and 0.06 or more falls in the range where the commercial value will be lost.

EXAMPLE 2

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (EXY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium doecylbenzenesulfonate. Separately another emulsion was prepared by adding two kinds of blue-sensitive sensitizing dye, shown below, to a silver chlorobromide emulsion (cubic grains, having 0.82 μm of average grain size and 0.08 of deviation coefficient of grain size distribution, in which 0.2 mol % of silver bromide was located at the surface of grains) in such amounts that dye corresponds $2.0\times10^{-4}$ mol to the emulsion per mol of silver, and then sulfur-sensitized. The thus-prepared emulsion and the above-obtained emulsified dispersion were mixed together and dissolved to give the composition shown below, thereby preparing the first-layer coating solution.

Coating solutions for the second to seventh layers were also prepared in the same manner as the first-layer coating solution. As a gelatin hardener for the respective layers, 1-hydroxy-3,5-dichloro-s-triazine sodium salt was used.

As spectral-sensitizing dyes for the respective layers, the following compounds were used:

Blue-sensitive emulsion layer:

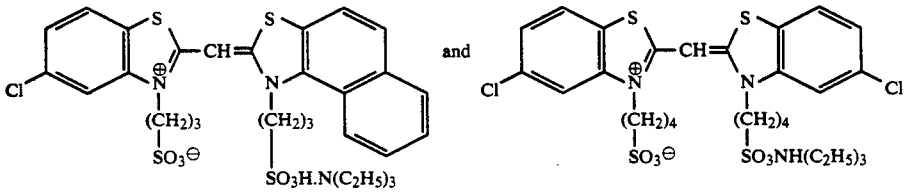

(each 2.0 × $10^{-4}$ mol per mol of silver halide)

Green-sensitive emulsion layer:

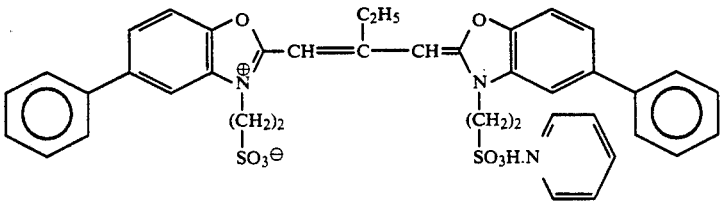

(5.6 × $10^{-4}$ mol per mol of silver halide) and

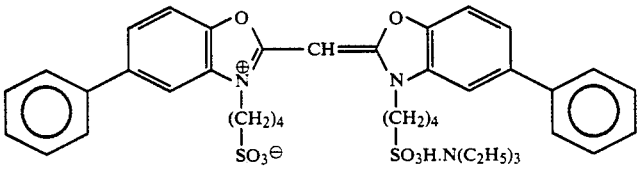

(1.0 × $10^{-5}$ mol per mol of silver halide)

Red-sensitive emulsion layer:

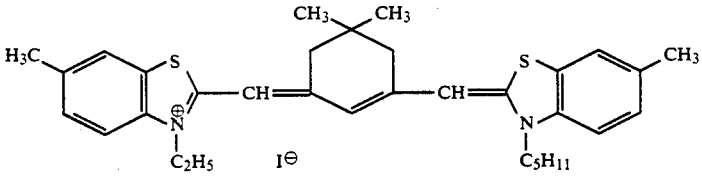

(1.0 × $10^{-4}$ mol per mol of silver halide)

To the red-sensitive emulsion layer, the following compound was added in an amount of $2.6\times10^{-3}$ mol per mol of silver halide:

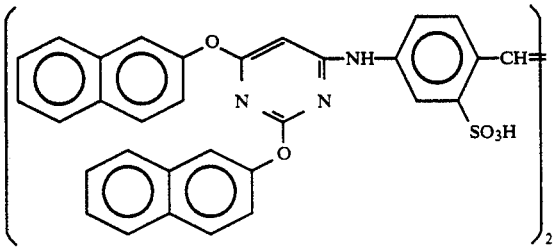

Further, 1-(5-methylureidophenyl)-5-mercaptotetrazole was added to the blue-sensitive emulsion layer, the green-sensitive emulsion layer, and red-sensitive emulsion layer in amounts of $8.5\times10^{-5}$ mol, $7.7\times10^{-4}$ mol, and $2.5\times10^{-4}$ mol, per mol of silver halide, respectively.

Further, 4-hydroxyl-6-methyl-1,3,3a, 7-tetrazaindene was added to the blue-sensitive emulsion layer and green-sensitive emulsion layer in amounts of $1\times10^{-4}$ mol and $2\times10^{-4}$ mol, per mol of silver halide, respectively.

The dyes shown below were added to the emulsion layers for prevention of irradiation:

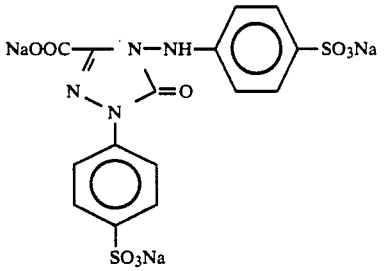

(7.1 mg per $m^2$ of photographic material)

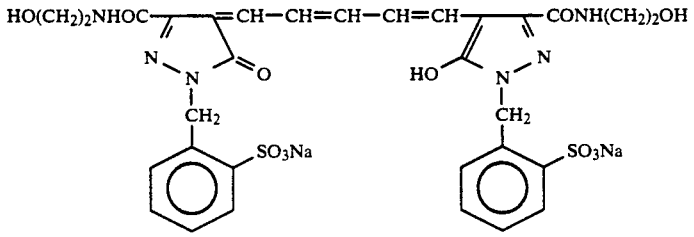

(14.7 mg per $m^2$ of photographic material)

and

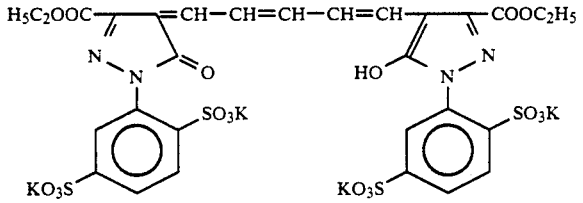

(36.2 mg per $m^2$ of photographic material)

Composition of Layers

The composition of each layer is shown below. The figures represent coating amount (g/$m^2$). The coating amount of each silver halide emulsion is given in terms of silver.

Supporting Base

Paper laminated on both sides with polyethylene (a white pigment, $TiO_2$, and a bluish dye, ultra-marine, were included in the first layer side of the polyethylene-laminated film.)

| | |
|---|---|
| First Layer (Blue-sensitive layer) | |
| The above-described silver chlorobromide emulsion | 0.25 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second layer (Color-mix preventing layer) | |
| Gelatin | 0.99 |
| Color-mix inhibitor (Cpd-5) | 0.08 |
| Solvent (Solv-1) | 0.16 |
| Solvent (Solv-4) | 0.08 |
| Third layer (Green-sensitive emulsion layer): | |
| Silver chlorobromide emulsion (cubic grains, having 0.40 μm of average grain size and 0.08 of deviation coefficient of grain size distribution, in which 0.8 mol % of AgBr was located at the surface of grains) | 0.12 |
| Gelatin | 1.24 |
| Magenta coupler (ExM) | 0.20 |

-continued

| | |
|---|---|
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth layer (Ultraviolet ray absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth layer (Red-sensitive emulsion layer): | |
| Silver chlorobromide emulsion (cubic grains, having 0.60 μm of average grain size and 0.09 of deviation coefficient of grain size distribution, in which 0.6 mol % of AgBr was located at the surface of grains) | 0.20 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler: (Y-31)
(ExM) Magenta coupler: (M-2)
(ExC) Cyan coupler
Mixture (2:4:4 in weight ratio) of R = $C_2H_5$ and $C_4H_9$ of
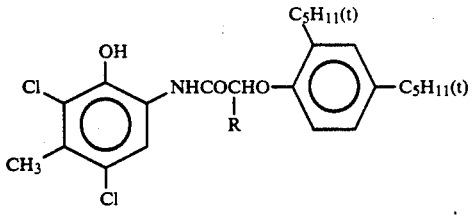
and
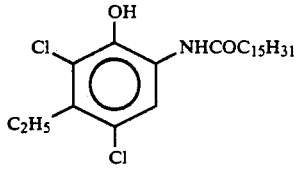
(Cpd-1) Image-dye stabilizer
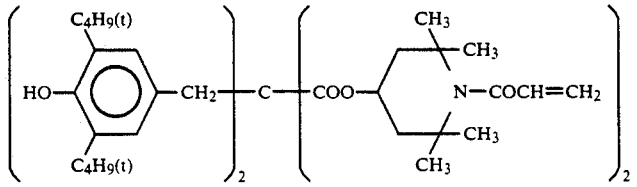
(Cpd-2) Image-dye stabilizer
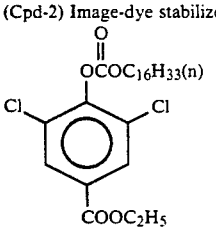
(Cpd-3) Image-dye stabilizer
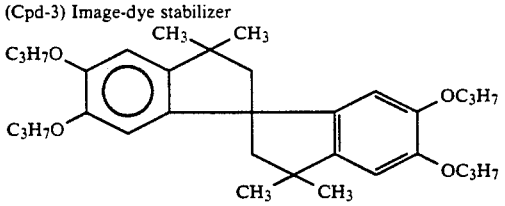
(Cpd-4) Image-dye stabilizer
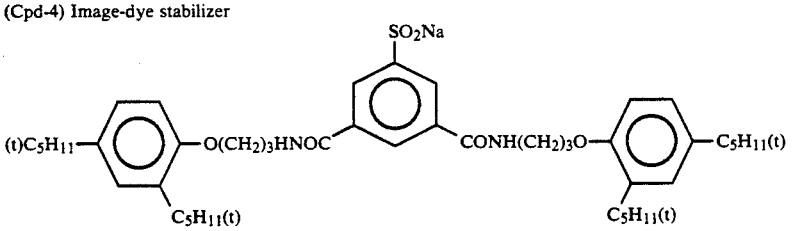
(Cpd-5) Color-mix inhibiter
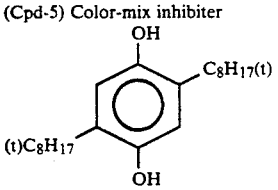

-continued
(Cpd-6) Image-dye stabilizer
Mixture (2:4:4 in weight ratio) of
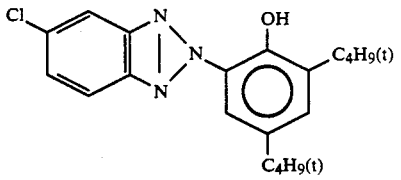
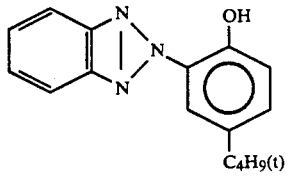
and
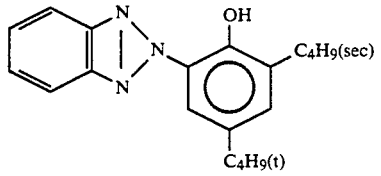
(Cpd-7) Image-dye stabilizer
$$\left(CH_2-\underset{\substack{|\\ CONHC_4H_9(t)}}{CH}\right)_n$$
(Cpd-8) Image-dye stabilizer
Mixture (1:1 in weight ratio) of
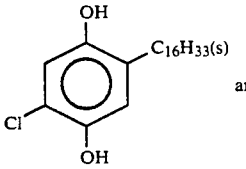
and
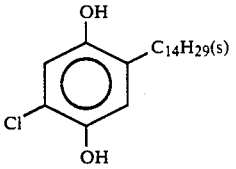
(Cpd-9) Image-dye stabilizer
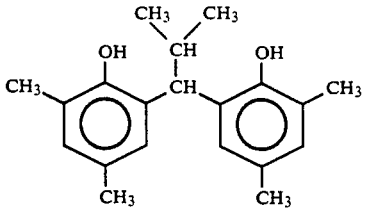
(UV-1) Ultraviolet ray absorber
Mixture (4:2:4 in weight ratio) of
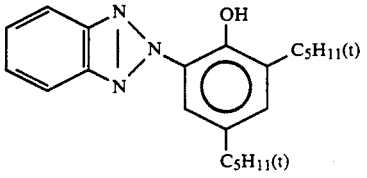

-continued
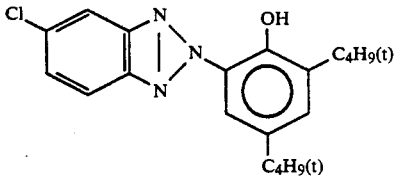
and
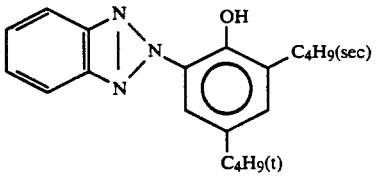
(Solv-1) Solvent
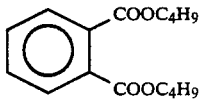
(Solv-2) Solvent
Mixture (2:1 in volume ratio) of
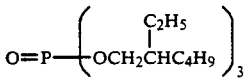
and
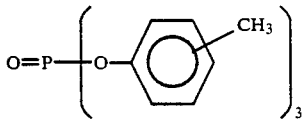
(Solv-3) Solvent
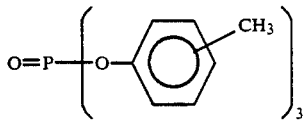
(Solv-5) Solvent
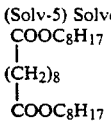
(Solv-6) Solvent
Mixture (95:5 in volume ratio) of
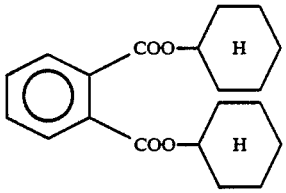
and
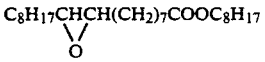
The thus-prepared sample was designated as 201. Samples 202 to 212 were prepared in the same manner as sample 201, except that yellow coupler and magenta coupler were changed as shown in Table 2, provided the coating weight being in equimolar amount, respectively.

After imagewise exposure to light, each sample was subjected to a continuous processing (running test) by the processing process shown below using a paper-processor, until a volume of color-developer twice that of a tank had been replenished.

The composition of color developer was changed as shown in Table 2.

| Processing process | Temperature (°C.) | Time (sec.) | Replenisher* | Tank Volume |
|---|---|---|---|---|
| Color development | 40 | 45 | 30 ml | 4 l |
| Bleach-fixing | 30–36 | 45 | 215 ml | 4 l |
| Stabilizing (1) | 30–37 | 20 | — | 2 l |
| Stabilizing (2) | 30–37 | 20 | — | 2 l |
| Stabilizing (3) | 30–37 | 20 | 364 ml | 2 l |
| Drying | 70–80 | 60 | | |

Note: *Replenisher amount per $m^2$ of photographic material
Stabilizing steps were conducted in three tanks counter-current flow system from the tank of stabilizing (3) toward the tank of stabilizing (1).

The compositions of each processing solution were as follows:

| | Tank Solution | Replenisher |
|---|---|---|
| Color developer | | |
| Water | 800 ml | 800 ml |
| Additive (See Table 2) | 0.2 g | 0.2 g |
| Ethylenediaminetetraphosphonic acid | 14.1 g | 14.1 g |
| Diethylenetriamineheptaacetic acid | 1.8 g | 1.8 g |
| 1-Hydroxyethylidene-1,1-diphophonic acid | 0.9 g | 0.9 g |
| Triethanolamine | 15.0 g | 15.0 g |
| Potassium chloride | 7.5 g | — |
| Potassium bromide | 0.03 g | — |
| Potassium carbonate | 25 g | 25 g |
| N-ethyl-N-(β-methanesulfonamidoethyl)-3-methyl-4-aminoaniline sulfonate | 5.0 g | 16.0 g |
| Hydrazinodiacetic acid | 0.05 mol | 0.08 mol |
| Sodium sulfite | 0.1 g | 0.2 g |
| Fluorescent brightening agent (WHITEX-4, made by Sumitomo Chemical Ind. Co.) | 1.0 g | 6.0 g |
| Water to make | 1000 ml | 1000 ml |
| pH (25° C.) | 10.00 | 11.25 |
| Bleach-fixing solution | | |

-continued

| | Tank Solution | Replenisher |
|---|---|---|
| (Both tank solution and replenisher) | | |
| Water | 400 ml | |
| Ammonium thiosulfate (70%) | 100 ml | |
| Sodium sulfite | 17 g | |
| Iron (III) ammonium ethylenediaminetetraacetate dihydrate | 55 g | |
| Disodium ethylenediaminetetraacetate | 5 g | |
| Glacial acetic acid | 9 g | |
| Water to make | 1000 ml | |
| pH (25° C.) | 5.40 | |
| Stabilizing solution | | |
| (Both tank solution and replenisher) | | |
| Formalin (37%) | 0.1 g | |
| Formalin-sulfite adduct | 0.7 g | |
| 5-Chloro-2-methyl-4-isothiazoline-3-one | 0.02 g | |
| 2-Methyl-4-isothiazoline-3-one | 0.01 g | |
| Copper sulfate | 0.005 g | |
| Aqueous ammonia (28%) | 2.0 g | |
| Water to make | 1000 ml | |
| pH (25° C.) | 4.0 | |

Coated samples were given gradation exposure for sensitometry using a sensitometer (FWH model, manufactured by Fuji Photo Film Co., Ltd.; the color temperature of the light source: 3200 K). At that time, exposure was effected such that the exposure time was 1/10 second and the exposure amount was 250 CMS.

Similarly to Example 1, at the start of the running test and after the completion of the running test, said sensitometry was processed, the yellow minimum density was measured by a Macbeth densitometer, and the increase in the yellow minimum density that resulted from the running was evaluated. The results are shown in Table 2.

After the coated samples were processed, they were subjected to gray exposure so that the density might be 0.5, and after the completion of the running, they were processed and the streak-like processing nonuniformity was evaluated. The results are shown in Table 2.

TABLE 2

| Experiment No. | Coated Sample | Yellow Coupler | Magenta Coupler | Additive | Yellow ΔDmin | Processing Streak | Remarks |
|---|---|---|---|---|---|---|---|
| 1 | 201 | Y-31 | M-2 | — | +0.04 | X | Comparative Example |
| 2 | 202 | Y-32 | M-2 | — | +0.05 | X | Comparative Example |
| 3 | 203 | RY-1 | M-2 | — | +0.06 | X | Comparative Example |
| 4 | 204 | RY-2 | M-2 | A-10 | +0.04 | X | Comparative Example |
| 5 | 205 | RY-3 | RM-1 | A-10 | +0.05 | X | Comparative Example |
| 6 | 201 | Y-31 | M-2 | A-10 | +0.01 | ○ | This Invention |
| 7 | 202 | Y-32 | M-2 | A-10 | +0.02 | Δ | This Invention |
| 8 | 202 | Y-32 | M-2 | A-9 | ±0 | ○ | This Invention |
| 9 | 206 | Y-35 | M-2 | A-9 | +0.01 | ○ | This Invention |
| 10 | 207 | Y-31 | M-7 | A-9 | +0.01 | ○ | This Invention |
| 11 | 208 | Y-31 | M-14 | A-9 | +0.02 | ○ | This Invention |
| 12 | 209 | Y-31 | M-16 | A-9 | ±0 | ○ | This Invention |
| 13 | 210 | Y-31 | RM-1 | A-9 | +0.01 | ○ | This Invention |
| 14 | 210 | Y-31 | RM-2 | A-9 | +0.02 | ○ | This Invention |
| 15 | 212* | Y-31 | RM-3 | A-9 | +0.01 | ○ | This Invention |

Note: *Coating amount of silver in green-sensitive emulsion layer of sample 212 was twice that of sample 201.
Criterion of evaluation for processing streak
○: Absence of streak
Δ: A little of streak (not remarkable)
X: Many streak (very remarkable)

Compounds used are as follows:

(A-9)
The same as in Example 1

(A-10)
The same as in Example 1

(RY-1)
The same as in Example 1

(RY-2)
The same as in Example 1
(Ry-3)
The same as in Example 1

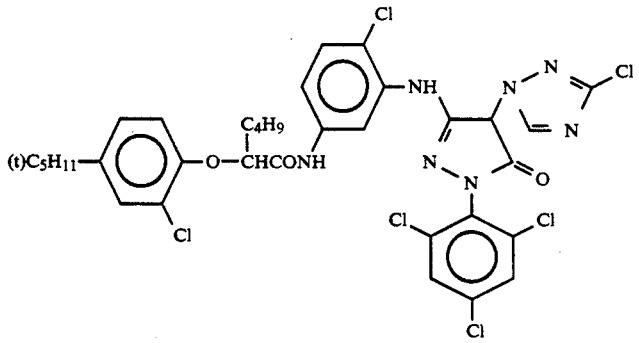
(RM-1)

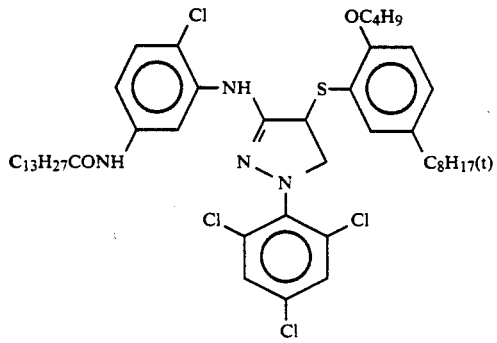
(RM-2)

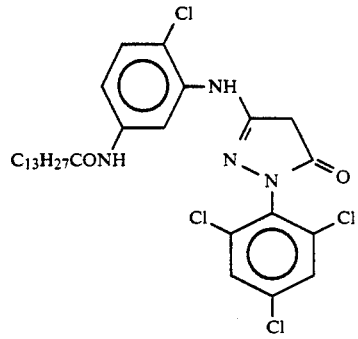
(RM-3)

As is apparent from the results in Table 2, when the constituent features of the present invention were satisfied, an increase of the yellow minimum density and the occurrence of processing streak with the progress of running processing were remarkably prevented, and therefore the objects of the present invention could be attained (Experiment Nos. 8 to 15).

When photographic material not containing the yellow coupler of the present invention was processed, an increase of the yellow minimum density and processing streak with the progress of running occurred irrespective of the presence or absence of the polymer of the present invention in the color developer, and therefore the objects of the present invention could not be attained (Experiment Nos. 3 to 7).

EXAMPLE 3

A photographic material was prepared by multi-coatings composed of the following for the first to fourteenth layers on one side, and for the fifteenth and sixteenth layers on the back side of a both-side polyethylene-laminated paper base (of thickness 100 μm). Titanium dioxide, as a white pigment, and a small amount of ultramarine blue, as a bluish dye, were included in the polyethylene film of the first-layer side (the chromaticity of the base surface in L*, a*, and b* were 88.0, −0.20, and −0.75, respectively).

Composition of photosensitive layers

In the following compositions each ingredient is indicated in g/m² of coating amount, but the coating amount of silver halide is indicated in terms of silver. Emulsions for each layer were prepared in accordance with the preparation procedure of EM-1, providing that the emulsion of the 14th layer used a Lipman emulsion that was chemically surface-ripened.

| | |
|---|---|
| First layer (Antihalation layer) | |
| Black coloidal silver | 0.10 |
| Gelatin | 0.70 |
| Second layer (Intermediate layer) | |
| Gelatin | 0.70 |
| Third layer (Low sensitivity red-sensitive emulsion layer) | |
| Silver bromide emulsion spectral-sensitized by red-sensitizing dyes (ExS-1, -2, and -3) (average grain size: 0.25 μm, grain size distribution (deviation coefficient): 8%, | 0.04 |

-continued

| | |
|---|---|
| octahedral) | |
| Silver chlorobromide emulsion spectral-sensitized by red-sensitizing dyes (ExS-1, -2, and -3) (silver chloride: 5 mol %, average grain size: 0.40 μm, grain size distribution: 10%, octahedral) | 0.08 |
| Gelatin | 1.00 |
| Cyan coupler (a blend of ExC-1 -2 in a ratio of 1:1) | 0.30 |
| Discoloration inhibitor (a blend of Cpd-1, -2, -3, and -4, each in equal amount) | 0.18 |
| Stain inhibitor (Cpd-5) | 0.003 |
| Coupler dispersion medium (Cpd-6) | 0.03 |
| Coupler solvent (a blend of Solv-1, -2, and -3, each in equal amount) | 0.12 |
| Fourth layer (High sensitivity red-sensitive emulsion layer) | |
| Silver bromide emulsion spectral-sensitized by red-sensitizing dyes (ExS-1, -2, and -3) (average grain size: 0.60 μm, grain size distribution: 15%, octahedral) | 0.14 |
| Gelatin | 1.00 |
| Cyan coupler (a blend of ExC-1 -2 in a ratio of 1:1) | 0.30 |
| Discoloration inhibitor (a blend of Cpd-1, -2, -3, and -4, each in equal amount) | 0.18 |
| Coupler dispersion medium (Cpd-6) | 0.03 |
| Coupler solvent (a blend of Solv-1, -2, and -3, each in equal amount) | 0.12 |
| Fifth layer (Intermediate layer) | |
| Gelatin | 1.00 |
| Color-mix inhibitor (Cpd-7) | 0.08 |
| Color-mix inhibitor solvent (a blend of Solv-4 and -5, each in equal amount) | 0.16 |
| Polymer latex (Cpd-8) | 0.10 |
| Sixth layer (Low sensitivity green-sensitive emulsion layer) | |
| Silver bromide emulsion spectral-sensitized by green-sensitizing dye (ExS-4) (average grain size: 0.25 μm, grain size distribution: 8%, octahedral) | 0.04 |
| Silver chlorobromide emulsion spectral-sensitized by green-sensitizing dye (ExS-4) (silver chloride: 5 mol %, average grain size: 0.40 μm, grain size distribution: 10%, octahedral) | 0.06 |
| Gelatin | 0.80 |
| Magenta coupler (a blend of ExM-1, -2, and -3, each in equal amount) | 0.10 |
| Discoloration inhibitor (a blend of Cpd-9 and -26, each in equal amount) | 0.15 |
| Stain inhibitor (a blend of Cpd-10, -11, -12, and -13 in a ratio of 10:7:7:1) | 0.025 |
| Coupler dispersion medium (Cpd-6) | 0.05 |
| Coupler solvent (a blend of Solv-4 and -6, each in equal amount | 0.15 |
| Seventh layer (High sensitivity green-sensitive emulsion layer | |
| Silver bromide emulsion spectral-sensitized by green-sensitizing dye (ExS-4) (average grain size: 0.65 μm, grain size distribution: 16%, octahedral) | 0.10 |
| Gelatin | 0.80 |
| Magenta coupler (a blend of ExM-1, -2, and -3, each in equal amount) | 0.10 |
| Discoloration inhibitor (a blend of Cpd-9 and -26, each in equal amount) | 0.15 |
| Stain inhibitor (a blend of Cpd-10, -11, -12, and -13 in a ratio of 10:7:7:1) | 0.025 |
| Coupler dispersion medium (Cpd-6) | 0.05 |
| Coupler solvent (a blend of Solv-4 and -6, each in equal amount) | 0.15 |
| Eighth layer (Intermediate layer) | |
| Same as the fifth layer | |
| Ninth layer (Yellow filter layer) | |
| Yellow colloidal silver | 0.12 |
| Gelatin | 0.70 |
| Color-mix inhibitor (Cpd-7) | 0.03 |
| Color-mix inhibitor solvent (a blend of Solv-4 and -5, each in equal amount) | 0.10 |
| Polymer latex (Cpd-8) | 0.07 |
| Tenth layer (Intermediate layer) | |
| Same as the fifth layer | |

-continued

| | |
|---|---|
| Eleventh layer (Low sensitivity blue-sensitive emulsion layer) | |
| Silver bromide emulsion spectral-sensitized by blue-sensitizing dyes (ExS-5 and -6) (average grain size: 0.40 μm, grain size distribution: 8%, octahedral) | 0.07 |
| Silver chlorobromide emulsion spectral-sensitized by blue-sensitizing dyes (ExS-5 and -6) (silver chloride: 8 mol %, average grain size: 0.60 μm, grain size distribution: 11%, octahedral) | 0.14 |
| Gelatin | 0.80 |
| Yellow coupler (ExY-1) | 0.35 |
| Discoloration inhibitor (Cpd-14) | 0.10 |
| Stain inhibitor (a blend of Cpd-5 and -15 in a ratio of 1:5) | 0.007 |
| Coupler dispersion medium (Cpd-6) | 0.05 |
| Coupler solvent (Solv-2) | 0.10 |
| Twelfth layer (High sensitivity blue-sensitive emulsion layer) | |
| Silver bromide emulsion spectral-sensitized by blue-sensitizing dyes (ExS-5 and -6) (average grain size: 0.85 μm, grain size distribution: 18%, octahedral) | 0.15 |
| Gelatin | 0.60 |
| Yellow coupler (ExY-1) | 0.30 |
| Discoloration inhibitor (Cpd-14) | 0.10 |
| Stain inhibitor (a blend of Cpd-5 and -15 in a ratio of 1:5) | 0.007 |
| Coupler dispersion medium (Cpd-6) | 0.05 |
| Coupler solvent (Solv-2) | 0.10 |
| Thirteenth layer (Ultraviolet absorbing layer) | |
| Gelatin | 1.00 |
| Ultraviolet absorber (a blend of Cpd-2, -4, and -16, each in equal amount) | 0.50 |
| Color-mix inhibitor (a blend of Cpd-7 and -17, each in equal amount) | 0.03 |
| Dispersion medium (Cpd-6) | 0.02 |
| Ultraviolet absorber solvent (a blend of Solv-2 and -7, each in equal amount) | 0.08 |
| Irradiation-inhibiting dye (a blend of Cpd-18, -19, -20, -21, and -27 in a ratio of 10:10:13:15:20) | 0.05 |
| Fourteenth layer (Protective layer) | |
| Fine grain silver chlorobromide emulsion (silver chloride: 97 mol %, average grain size: 0.1 μm) | 0.03 |
| Copolymer of acryl-modified poly(vinyl alcohol) | 0.01 |
| Poly(methyl methacrylate) particle (average particle size: 2.4 μm) and silicon dioxide (average particle size: 5 μm) (a blend in equal amount) | 0.05 |
| Gelatin | 1.80 |
| Gelatin hardener (a blend of H-1 and H-2 in equal amount) | 0.18 |
| Fifteenth layer (Back-side layer) | |
| Gelatin | 2.50 |
| Ultraviolet absorber (a blend of Cpd-2, -4, and -16, each in equal amount) | 0.50 |
| Dye (a blend of Cpd-18, -19, -20, 21, and -27, each in equal amount) | 0.06 |
| Sixteenth layer (Back-side protective layer) | |
| Poly(methyl methacrylate) particle (average dioxide (average particle size: 5 μm) (a blend in equal amount) | 0.05 |
| Gelatin | 2.00 |
| Gelatin hardener (a blend of H-1 and H-2 in equal amount) | 0.14 |

Preparation of emulsion EM-1

Aqueous solutions containing potassium bromide and silver nitrate were simultaneously added to an aqueous solution of gelatin with vigorous agitation at 75° C. over 15 minutes, to obtain a silver bromide emulsion of octahedral grains having an average grain size of 0.35 μm. A chemical-sensitizing treatment of the thus-obtained emulsion was carried out by adding, in order, 0.3 g/mol·Ag of 3,4-dimethyl-1,3-thiazoline-2 thione, 6 mg/mol·Ag of sodium thiosulfate, and 7 mg/mol·Ag of chloroauric acid (tetrahydrate) and heating it at 70° C. for 80 minutes. The thus-obtained silver bromide grains were brought up as a core in the same precipitating conditions as the first precipitating process, to obtain finally a monodisperse core-shell silver bromide emulsion of octahedral-shaped grains having an average grain size of 0.7 μm. The deviation coefficient of the grain size distribution of this emulsion was about 10%. A further chemical sensitization of this emulsion was carried out by adding 1.5 mg/mol·Ag of sodium thiosulfate and 1.5 mg/mol·Ag of chloroauric acid (tetrahydrate) and heating it at 60° C. for 60 minutes, to obtain an internal latent-image type silver halide emulsion.

In each photosensitive layer, the compounds ExZK-1 and ExZK-2, in amounts of $10^{-3}$ and $10^{-2}$ weight % to the coating amount of silver halide, respectively, were included as nucleating agents, and $10^{-2}$ weight % of compound Cpd-22 was included as a nucleation accelerator. Further, Alkanol XC (trade name, made by Dupont) and sodium alkylbenzenesulfonate were used as auxiliary agents for the emulsification and dispersion, and succinate ester and Magefac F-120 (trade name, made by Dai Nippon Ink & Chemicals Inc.) were added as coating aids to each layer. In the layers containing silver halide emulsion or colloidal silver, compounds Cpd-23, -24, and -25 were used as stabilizers.

The thus-prepared sample was designated as 301.

Samples 302 to 307 were prepared in the same manner as 301, except that the yellow coupler was changed as shown in Table 3, providing the coating amount being equimolar amount, respectively.

Compounds used in the Example are shown below.

ExS-1

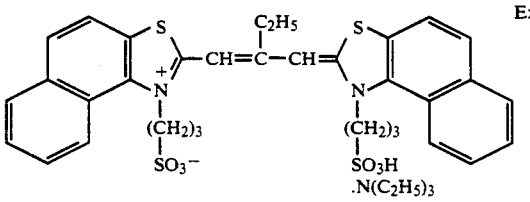

ExS-2

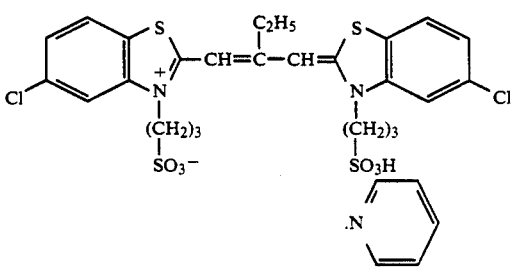

ExS-3

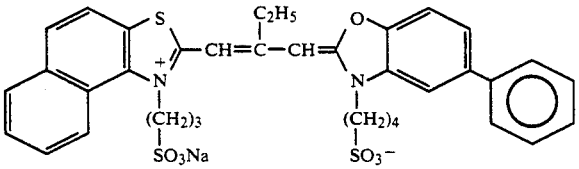

ExS-4

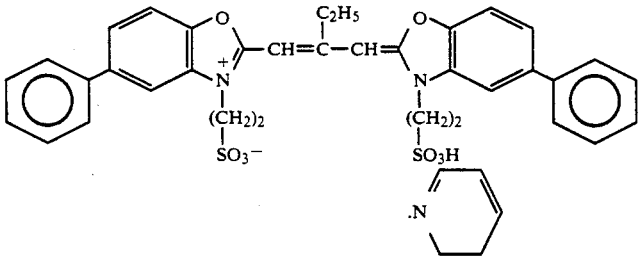

ExS-5

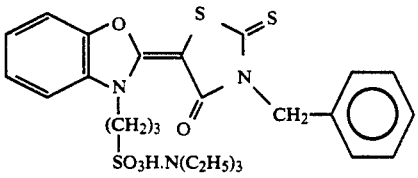

ExS-6

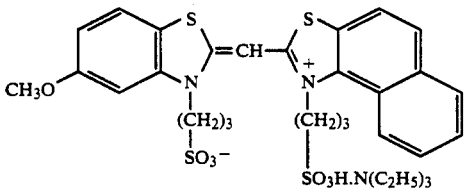

Cpd-1

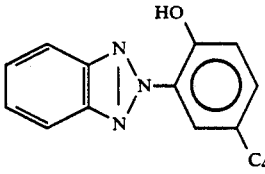

Cpd-2

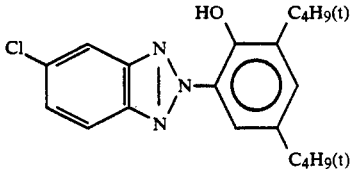

-continued
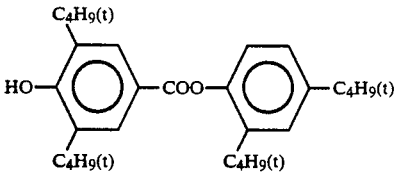
Cpd-3
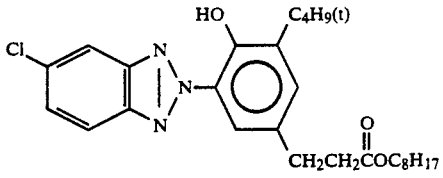
Cpd-4
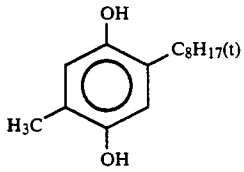
Cpd-5
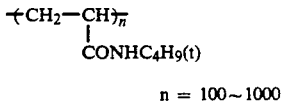
Cpd-6
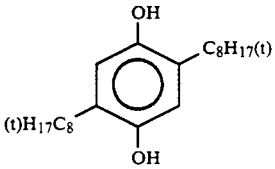
Cpd-7
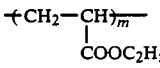
Cpd-8
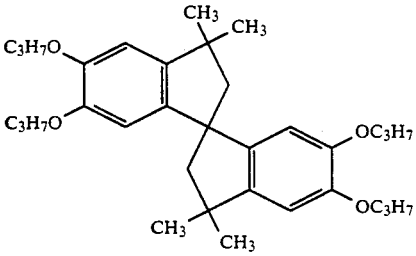
Cpd-9
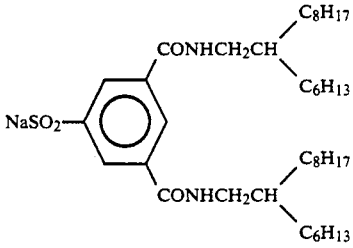
Cpd-10
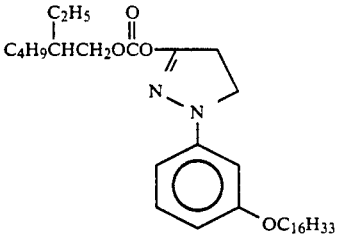
Cpd-11
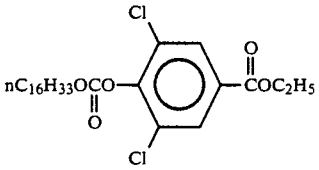
Cpd-12
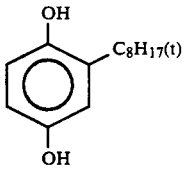
Cpd-13
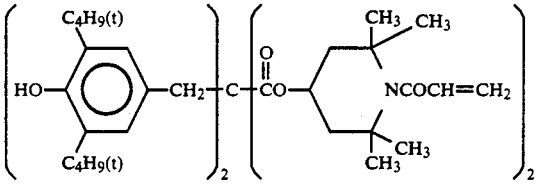
Cpd-14
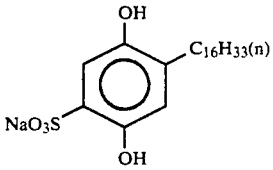
Cpd-15
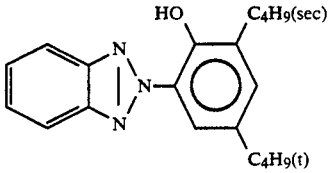
Cpd-16

-continued
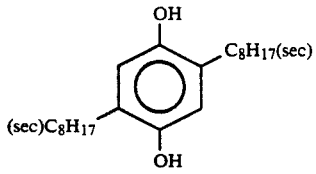
Cpd-17
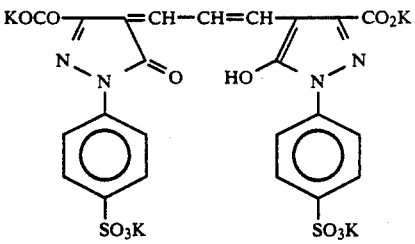
Cpd-18
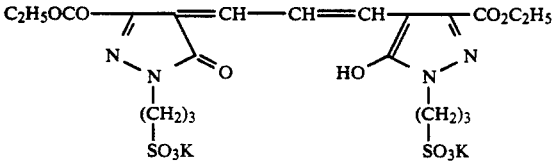
Cpd-19
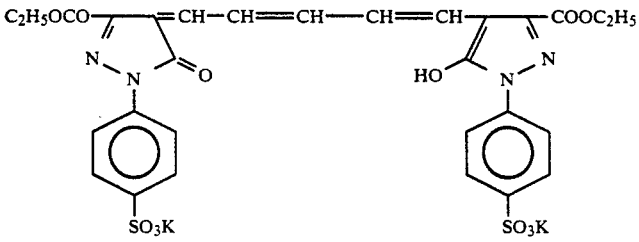
Cpd-20
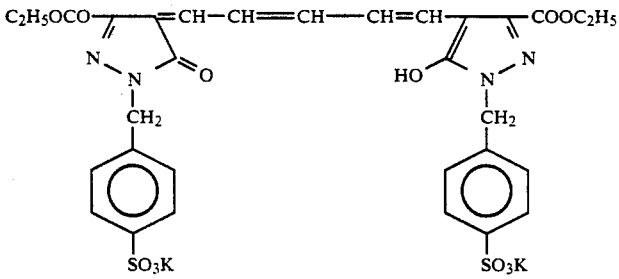
Cpd-21
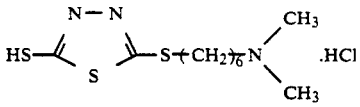
Cpd-22
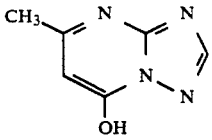
Cpd-23
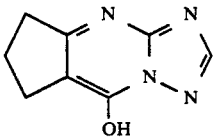
Cpd-24
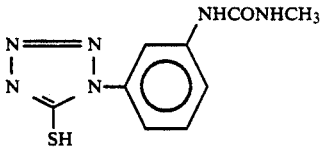
Cpd-25
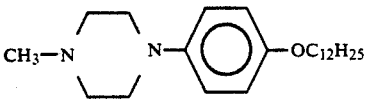
Cpd-26
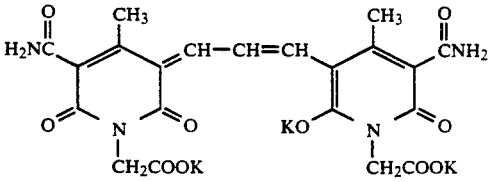
Cpd-27

-continued

ExC-1

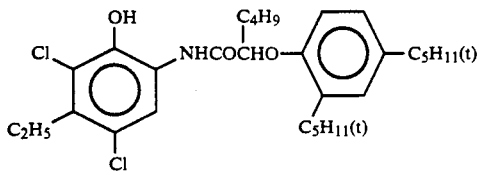

(M-2)

ExC-2

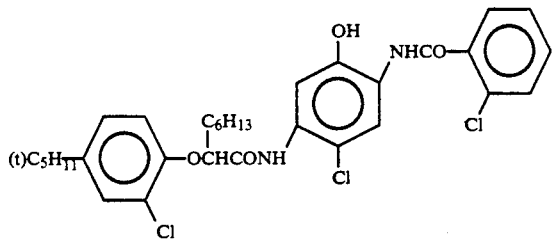

ExM-1

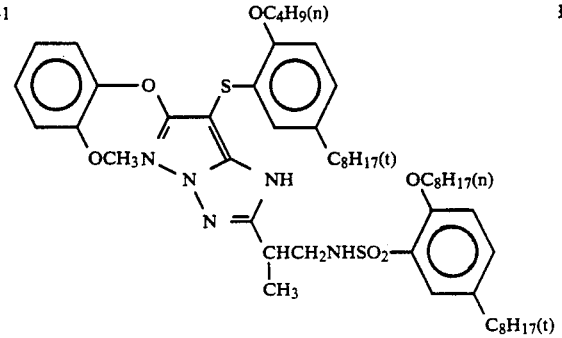

(M-16)

ExM-2

(Y-31)

ExY-1

Solv-1: Di(2-ethylhexyl)sebacate
Solv-2: Trinonyl phosphate
Solv-3: Di(3-methylhexyl)phthalate
Solv-4: Tricresyl phosphate
Solv-5: Dibutyl phthalate
Solv-6: Trioctyl phosphate
Solv-7: Di(2-ethylhexyl)phthalate
H-1: 1,2-Bis(vinylsulfonylacetoamido)ethane
H-2: 4,6-Dichloro-2-hydroxy-1,3,5-triazine sodium salt ExZK-1: 7-(3-Ethoxycarbonylaminobenzamido)-9-methyl-10-propagyl-1,2,3,4-tetrahydroacrylginium trifluoromethanesulfonate ExZk-2: 2-[4-{3-[3-{-[5-{3-[2-chloro-5-(1-dodecyloxycarbonylethoxycarbonyl)phenylcarbamoyl]-4-hydroxy-1-naphtylthio}tetrazole-1-yl]phenyl}ureido]-benzenesulfonamido}phenyl]-1-formylhydrazine The thus-prepared photographic materials were subjected to cutting process and an image wise exposure to light. Then they were processed continuously by the process shown below until the accumulated replenishing amount of the solution reached twice the tank volume, using an automatic processor.

| Processing Steps | Time | Temperature | Tank Volume | Replenisher Amount |
|---|---|---|---|---|
| Color Development | 135 sec | 38° C. | 15 l | 300 m l/m$^2$ |
| Bleach-fixing | 40 sec | 33° C. | 3 l | 300 m l/m$^2$ |
| Water washing (1) | 40 sec | 33° C. | 3 l | — |
| Water washing (2) | 40 sec | 33° C. | 3 l | 320 m l/m$^2$ |
| Drying | 30 sec | 80° C. | | |

Washing was carried out in a so-called counter-current mode, in which the overflow solution of the tank of washing (2) was led to the tank of washing (1). The amount of carried over bleach-fixing solution by the photographic material from the bleach-fixing tank to the tank of washing (1) was 35 ml/m$^2$ and the magnification of replenishing amount to the carried over amount of bleach-fixing was 9.1.

The composition of each processing solution was as follows:

| | Mother Solution | Replenisher |
|---|---|---|
| Color developer | | |
| Ethylenediaminetetrakismethylene phosphonic acid | 1.5 g | 1.5 g |
| Diethylene glycol | 10 ml | 10 ml |
| Benzyl alcohol | 12.0 ml | 14.4 ml |
| Potassium bromide | 0.70 g | — |
| Benzotriazole | 0.003 g | 0.004 g |
| Sodium sulfite | 2.4 g | 2.9 g |
| Glucose | 2.5 g | 3.0 g |
| D-Sorbit | 0.15 g | 0.20 g |
| N,N-Bis(carboxymethyl)hydrazine | 4.0 g | 4.8 g |
| folmarin adduct | 0.15 g | 0.20 g |
| Triethanolamine | 6.0 g | 8.0 g |
| N-Ethyl-N-(β-methanesulfonamidoethyl)-3-methyl-4-aminoaniline sulfate | 6.0 g | 7.2 g |
| Potassium carbonate | 30.0 g | 25.0 g |
| Fluorescent brightening agent (WHITEX-4, manufactured by Sumitomo Chemical Ind. Co.) | 1.0 g | 1.2 g |
| D-Glucose | 2.0 g | 2.4 g |
| Water to make | 1000 ml | 1000 ml |
| pH (25° C.) | 10.25 | 10.85 |
| Bleach-fixing solution | | |
| (Mother solution and replenisher are the same) | | |
| Disodium ethylenediaminetetraacetate | | 4.0 g |
| Iron (III) ammonium ethylenediaminetetraacetate dihydrate | | 70.0 g |
| Ammonium thiosulfate (700 g/l) | | 180 ml |
| Sodium p-toluenesulfinate | | 20.0 g |
| Ammonium bisulfite | | 0.2 mol |
| 5-Mercapto-1,3,4-triazole | | 0.5 g |
| Ammonium nitrate | | 10.0 g |
| Water to make | | 1000 ml |
| pH (25° C.) | | 6.20 |

Water washing solution

Mother solution and replenisher are the same

Tap water was treated by passage through a hybrid-type column filled with an H-type strong acidic cation-exchange resin (Amberlite IR-120B, tradename, made by Rohm & Haas) and an OH-type strong alkaline anion-exchange resin (Amberlite IR-400, tradename, made by the same as the above) so as to make the concentrations of calcium ions and magnesium ions 3 mg/l or below. Then 20 mg/l of sodium dichloroisocyanurate and 1.5 g/l of sodium sulfate were added. The pH of the solution was in a range of 6.5 to 7.5.

Coated samples above-described were given gradation exposure to light using a sensitometer (FWH model, manufactured by Fuji Photo Film Co., Ltd.; the color temperature of the light source: 3200K). At that time, exposure was effected such that the exposure time was 1/10 sec and the exposure amount was 250 CMS.

At the start of the running test and after the completion of the running test, said sensitometry was processed, the yellow minimum density was measured by a Macbeth densitometer, and the inarease in the yellow minimum density that resulted from the running was evaluated. The results are shown in Table 3.

After the running was completed, the coated samples were subjected to gray exposure to light so that the density might be 0.5 and they were processed and the processing streak was evaluated. The results are shown in Table 3.

TABLE 3

| Experiment No. | Coated Sample | Yellow Coupler | Additive | Yellow ΔDmin | Processing Streak | Remarks |
|---|---|---|---|---|---|---|
| 1 | 301 | Y-31 | — | +0.05 | X | Comparative Example |
| 2 | 302 | Y-35 | — | +0.04 | X | Comparative Example |
| 3 | 303 | RY-1 | — | +0.06 | X | Comparative Example |
| 4 | 303 | RY-1 | A-10 | +0.05 | X | Comparative Example |
| 5 | 304 | RY-2 | A-10 | +0.05 | X | Comparative Example |
| 6 | 305 | RY-3 | — | +0.04 | X | Comparative Example |
| 7 | 301 | Y-31 | A-10 | +0.01 | ○ | This Invention |
| 8 | 301 | Y-31 | A-1 | +0.02 | Δ | This Invention |
| 9 | 301 | Y-31 | A-17 | +0.02 | ○ | This Invention |
| 10 | 301 | Y-31 | A-9 | +0.01 | ○ | This Invention |
| 11 | 302 | Y-35 | A-9 | +0.01 | ○ | This Invention |
| 12 | 306 | Y-32 | A-9 | +0.01 | ○ | This Invention |
| 13 | 307 | Y-20 | A-9 | +0.02 | ○ | This Invention |

Note: Criterion of evaluation for processing streak
○: Absence of streak
Δ: A little of streak (not remarkable)
X: Many streak (very remarkable)

Compounds used are as follows:
(RY-1)
The same as in Example 1
(RY-2)
The same as in Example 1
(RY-3)
The same as in Example 1
(A-1)
The same as in Example 1
(A-9)
The same as in Example 1
(A-10)
The same as in Example 1
(A-17)

As is apparent from the results in Table 3, even in the case wherein direct positive-type color photographic materials were used, when the constituent features of the present invention were satisfied, an increase of the yellow minimum density and the occurrence of processing streak with the progress of running processing were remarkably prevented, and therefore the objects of the present invention could be attained.

EXAMPLE 4

Coated samples 201 and 205 which were prepared in Example 2 were subjected to an exposure to light so as to obtain the density of 0.5 and to a development processing according to the processing process shown below and using processing solutions having composition shown below.

| Processing step | Temperature | Time |
|---|---|---|
| Color developing | see Table 4 | see Table 4 |
| Bleach-fixing | 35° C. | 45 sec. |
| Rinsing (1) | 35° C. | 20 sec. |
| Rinsing (2) | 35° C. | 20 sec. |
| Rinsing (3) | 35° C. | 20 sec. |
| Rinsing (4) | 35° C. | 20 sec. |
| Drying | 80° C. | 60 sec. |

| Color developer | |
|---|---|
| Water | 700 ml |
| Additive (see Table 4) | 0.2 g |
| Ethylenediaminetetraacetic acid | 3.0 g |
| Disodium 1,2-dihydroxybenzene-4,6-disulfonate | 0.5 g |
| Triethanolamine | 12.0 g |
| Potassium chloride | 6.5 g |
| Potassium bromide | 0.03 g |
| Potassium carbonate | 27 g |
| Fluorescent brightening agent (WHITEX-4, made by Sumitomo Chemical Ind.) | 1.0 g |
| Sodium sulfite | 0.1 g |
| Disodium-N,N-bis(sulfonatoethyl)-hydroxylamine | 10.0 g |
| N-ethyl-N-(β-methanesulfonamidoethyl)-3-methyl-4-aminoaniline sulfate | 5.0 g |
| Water to make | 1000 ml |
| pH (25° C.) | 10.00 |
| **Bleach-fixing solution** | |
| Water | 600 ml |
| Ammonium thiosulfate (700 g/l) | 100 ml |
| Ammonium sulfite | 40 g |
| Iron (III) ammonium ethylenediaminetetraacetate | 55 g |
| Ethylenediaminetetraacetic acid | 5 g |
| Ammonium bromide | 40 g |
| Nitric acid (67%) | 30 g |
| Water to make | 1000 ml |
| pH (25° C.) (adjusted by acetic acid on aqueous ammonia) | see Table 4 |

Rinsing Solution

Ion-exchanged water (each content of calcium and magnesium was 3 ppm or below)

Thus-processed samples 201 and 205 were evaluated the processing streak.

The frequency of occurrence of processing streak was evaluated as the number of sheets which was observed visually the occurrence of processing streak in 100 sheets each having size of 8.25 cm×11.7 cm.

Further, density difference of processing streaks between a low density part and a high density part of sample occurred processing streak were measured by Macbeth densitometer (visual density), and the degree of remarkability of streak was evaluated by the maximum value of density difference.

Results are shown in Table 4.

The temperature of color developer was settled such that the maximum density of yellow would be 2.1 in each processing time. That value was shown in Table 4. The processing time of color development represents the time after the top end of the sample enters the color developer till it enters the successive bleach-fixing solution, the processing was carried out in such a condition that the time (time in the air) after the sample came out the color developer till it came into the bleach-fixing solution would be 10% of the processing time of color development.

Therefore, form the results in Table 4, it is more preferably, among the present invention, that the color-developing time is 35 sec. or less.

Further, it is more preferably, among the present invention, that the pH of bleach-fixing solution is 4.5 to 6.5 because of less occurrence of processing streak, as shown in Experiment Nos. 12 to 16. In particular, the pH of bleach-fixing solution of 5.0 to 6.0 is more preferably because of the processing streak not occurring at all.

EXAMPLE 5

Coated sample 201 which was used in Example 2 was subjected to an exposure to light so as to obtain the density of 0.5 and a development processing according to the processing process shown below and using processing solutions having composition shown below.

| Processing step | Temperature | Time |
|---|---|---|
| Color developing | see Table 5 | see Table 5 |
| Bleach-fixing | 35° C. | 45 sec. |
| Rinsing (1) | 35° C. | 20 sec. |
| Rinsing (2) | 35° C. | 20 sec. |
| Rinsing (3) | 35° C. | 20 sec. |
| Rinsing (4) | 35° C. | 20 sec. |
| Drying | 80° C. | 60 sec. |

| Color developer | |
|---|---|
| Water | 700 ml |
| Additive (A-10) | 0.2 g |
| Ethylenediaminetetraacetic acid | 3.0 g |
| Disodium 1,2-dihydroxybenzene-4,6-disulfonate | 0.5 g |
| Triethanolamine | 12.0 g |
| Potassium chloride | 8.0 g |
| Potassium bromide | 0.04 g |
| Potassium carbonate | 27 g |
| Fluorescent brightening agent (WHITEX-4, made by Sumitomo Chemical Ind.) | 1.0 g |
| Sodium sulfite | 0.1 g |
| Diethylhydroxylamin | 5.0 g |
| N-ethyl-N-(β-methanesulfonamidoethyl)-3-methyl-4-aminoaniline sulfate | 5.0 g |
| Water to make | 1000 ml |
| pH (25° C.) | 10.00 |

TABLE 4

| Experiment No. | Sample No. | Yellow Coupler | Additive | Processing Time (sec.) | Temperature of Color Developer (°C.) | pH of Bleach-fixing Solution | Processing Streak: Frequency of Occurrence (%) | Processing Streak: Difference of Density | Remarks |
|---|---|---|---|---|---|---|---|---|---|
| 1 | 205 | RY-3 | — | 60 | 33 | 5.5 | 20 | 0.09 | Comparative Example |
| 2 | 201 | Y-31 | — | 60 | 33 | 5.5 | 19 | 0.09 | Comparative Example |
| 3 | 205 | RY-3 | A-9 | 60 | 33 | 5.5 | 16 | 0.08 | Comparative Example |
| 4 | 201 | Y-31 | A-9 | 60 | 33 | 5.5 | 0 | — | This Invention |
| 5 | 205 | RY-3 | — | 45 | 38 | 5.5 | 28 | 0.10 | Comparative Example |
| 6 | 201 | Y-31 | — | 45 | 38 | 5.5 | 22 | 0.09 | Comparative Example |
| 7 | 205 | RY-3 | A-9 | 45 | 38 | 5.5 | 23 | 0.09 | Comparative Example |
| 8 | 201 | Y-31 | A-9 | 45 | 38 | 5.5 | 0 | — | This Invention |
| 9 | 205 | RY-3 | — | 35 | 39.5 | 5.5 | 80 | 0.23 | Comparative Example |
| 10 | 201 | Y-31 | — | 35 | 39.5 | 5.5 | 74 | 0.22 | Comparative Example |
| 11 | 205 | RY-3 | A-9 | 35 | 39.5 | 5.5 | 78 | 0.21 | Comparative Example |
| 12 | 201 | Y-31 | A-9 | 35 | 39.5 | 5.5 | 0 | — | This Invention |
| 13 | 201 | Y-31 | A-9 | 35 | 39.5 | 4 | 4 | 0.05 | This Invention |
| 14 | 201 | Y-31 | A-9 | 35 | 39.5 | 4.5 | 1 | 0.03 | This Invention |
| 15 | 201 | Y-31 | A-9 | 35 | 39.5 | 6.5 | 1 | 0.03 | This Invention |
| 16 | 201 | Y-31 | A-9 | 35 | 39.5 | 7 | 3 | 0.05 | This Invention |
| 17 | 205 | RY-3 | — | 25 | 42 | 5.5 | 95 | 0.25 | Comparative Example |
| 18 | 201 | Y-31 | — | 25 | 42 | 5.5 | 97 | 0.24 | Comparative Example |
| 19 | 205 | RY-3 | A-9 | 25 | 42 | 5.5 | 94 | 0.24 | Comparative Example |
| 20 | 201 | Y-31 | A-9 | 25 | 42 | 5.5 | 0 | — | This Invention |

As is apparent form the results in Table 4, it can be noticed that when the yellow coupler of the present invention and the copolymer of vinyl alcohol of the present invention were not contained (Experiment Nos. 1 to 30, 5 to 7, 9, 10, and 17 to 19), the processing streak occurred largely and the frequency of occurrence of processing streak and the difference of density came further large as the color developing being conducted rapidly (compared Nos. 5 and 7 with No. 1). On the contrary, according to the constituent of the present invention, the processing streak was very little or was quite prevented and the occurrence of processing streak was prevented remarkably even the color-developing being conducted rapidly (Experiment Nos. 4, 8, 12 to 16, and 20). The differences compared with comparative examples came more largely as the color-developing being carried out more rapidly (compared the difference between No. 1 and No. 4 with the difference between No. 17 and No. 20). It can be noticed that the more rapidly the color-developing in conducted, the more largely the effect of the present invention is.

-continued

| Bleach-fixing solution | |
|---|---|
| Water | 600 ml |
| Ammonium thiosulfate (700 g/l) | 100 ml |
| Sodium sulfite | 40 g |
| Iron (III) ammonium ethylenediaminetetraacetate | 55 g |
| Ethylenediaminetetraacetic acid | 5 g |
| Ammonium bromide | 40 g |
| Nitric acid (67%) | 30 g |
| Water to make | 1000 ml |
| pH (25° C.) (adjusted by acetic acid or aqueous ammonia) | see Table 5 |

Rinsing solution

Ion-exchanged water (each content of calcium and magnesium was 3 ppm or below)

Thus-processed sample 201 was evaluated the processing streak.

The frequency of occurrence of processing streak was evaluated as the number of sheets which was observed visually the occurrence of processing streak in 100 sheets each having size of 8.25 cm×11.7 cm.

Further, density difference of processing streaks between a low density part and a high density part of sample occurred processing streak were measured by Macbeth densitometer (visual density), and the degree of remarkability of streak was evaluated by the maximum value of density difference.

Results are shown in Table 5.

The temperature of color developer was settled such that the maximum density of yellow would be 2.1 in each processing time. That value was shown in Table 5. The processing time of color development represents the time after the top end of the sample enters the color developer till it enters the successive bleach-fixing solution, the processing was carried out in such a condition that the time (time in the air) after the sample came out the color developer till it came into the bleach-fixing solution would be 10% of the processing time of color development.

TABLE 5

| Experiment No. | Color-Developing Time (sec.) | Ratio of Time in the Air to Color-Developing Time (%) | Temperature of Color-Developing (°C.) | pH of Bleach-fixing | Processing Streak: Frequency of Occurrence (%) | Processing Streak: Difference of Density | Remarks |
|---|---|---|---|---|---|---|---|
| 1 | 45 | 1 | 38.5 | 5.5 | 2 | 0.03 | This Invention |
| 2 | 45 | 3 | 38.5 | 5.5 | 1 | 0.02 | This Invention |
| 3 | 45 | 10 | 38.5 | 5.5 | 0 | — | This Invention |
| 4 | 45 | 25 | 38.5 | 5.5 | 1 | 0.02 | This Invention |
| 5 | 45 | 30 | 38.5 | 5.5 | 3 | 0.04 | This Invention |
| 6 | 35 | 1 | 40.0 | 5.5 | 3 | 0.05 | This Invention |
| 7 | 35 | 3 | 40.0 | 5.5 | 1 | 0.02 | This Invention |
| 8 | 35 | 10 | 40.0 | 5.5 | 0 | — | This Invention |
| 9 | 35 | 25 | 40.0 | 5.5 | 2 | 0.02 | This Invention |
| 10 | 35 | 30 | 40.0 | 5.5 | 4 | 0.06 | This Invention |
| 11 | 35 | 10 | 40.0 | 4 | 5 | 0.05 | This Invention |
| 12 | 35 | 10 | 40.0 | 4.5 | 2 | 0.04 | This Invention |
| 13 | 35 | 10 | 40.0 | 6.5 | 1 | 0.03 | This Invention |
| 14 | 35 | 10 | 40.0 | 7 | 5 | 0.06 | This Invention |

As is shown in Experiment Nos. 1 to 11, it can be noticed that it is more preferable, among the present invention, when the ratio (%) of time after the sample comes out of a color developer till it comes into a bleach-fixing solution (time at the air) to color-developing time is in 3 to 25%, in view of prevention of occurrence of processing streak.

Further, particularly preferable when the ratio of time in the air to color-developing time is in 5 to 20%.

In addition, as is shown in Experiment Nos. 8 and 11 to 14, it is more preferable, among the present invention, when the pH of bleach-fixing solution is in 4.5 to 6.5, because of little occurrence of processing streak. Further, particularly preferable when the pH is in 5.0 to 6.0 because of the occurrence of processing streak being not at all.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for processing a silver halide color photographic material which has been image-wise exposed to light, wherein said silver halide color photographic material contains at least one of yellow couplers represented by the following formula (Y):

Formula (Y)

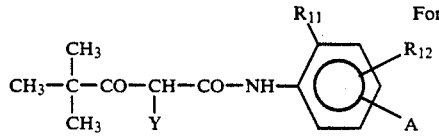

wherein $R_{11}$ represents a halogen atom, an alkoxy group, a trifluoromethyl group, or an aryl group, $R_{12}$ represents a hydrogen atom, a halogen atom, or an alkoxy group, A represents $—NHCOR_{13}$, $—NHSO_2—R_{13}$, $—SO_2NHR_{13}$, $—COOR_{13}$ or $$—SO_2N(R_{14})—R_{13}$$

wherein $R_{13}$ and $R_{14}$ each represent an alkyl group, an aryl group, or an acyl group, and Y represents a group capable of being released, wherein said process comprises processing said silver halide color photographic material with a color developer containing at least one aromatic primary amine color developing agent and at least one polymer selected from the group consisting of vinyl alcohol homopolymers, and vinyl alcohol copolymers,

2. The method as claimed in claim 1, wherein Y in formula (Y) includes groups represented by the following formulae (Xa) to (Xd):

(Xa)

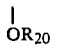

wherein $R_{20}$ represents a substituted aryl or heterocyclic group, (Xb)

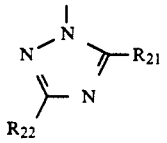

(Xc)

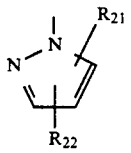

wherein $R_{21}$ and $R_{22}$, which may be the same or different, each represent a hydrogen atoms, a halogen atom, a carboxylate group, an amino group, an alkyl group, an alkylthio group, an alkoxy group, an alkylsulfonyl group, an alkylsulfinyl group, a carboxylic acid group, a sulfonic acid group, a phenyl group, or a heterocyclic group, (Xd)

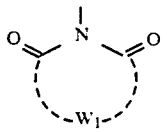

wherein $W_1$ represents a group of nonmetallic atoms required to form a 4-, 5- or 6-membered ring together with the

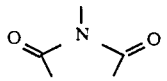

in the formula.

3. The method as claimed in claim 2, wherein formula (Xd) is selected from the following formulae (Xe) to (Xg), (Xe)

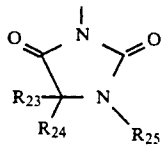

(Xf)

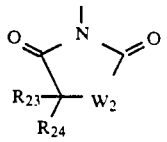

-continued (Xg)

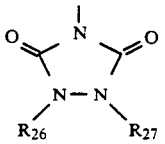

wherein $R_{23}$ and $R_{24}$ each represent a hydrogen atom, an alkyl group, an aryl group, an alkoxy group, an aryloxy group, or a hydroxy group, $R_{25}$, $R_{26}$, and $R_{27}$ each represent a hydrogen atom, an alkyl group, an aryl group, an aralkyl group, or an acyl group, and $W_2$ represents an oxygen atom or a sulfur atom.

4. The method as claimed in claim 1, wherein the coupler represented by formula (Y) is contained in an amount of 0.1 to 1.0 mol per mol of silver halide in a silver halide emulsion layer constituting a photosensitive layer of said material.

5. The method as claimed in claim 1, wherein the polymer contained in the color developer has a molecular weight of 100 to 50,000.

6. The method as claimed in claim 1, wherein the polymer contained in the color developer is selected from the group consisting of copolymers containing 40 mol % or more of vinyl alcohol.

7. The method as claimed in claim 1, wherein the amount of polymer to be added to the color developer is 0.05 to 2 g/l.

8. The method as claimed in claim 1, wherein the photographic material comprises a high-silver chloride emulsion containing 80 mol % or more of silver chloride.

9. The method as claimed in claim 1, wherein the coating amount of silver of silver halide emulsion in the photographic material is 0.75 g or less per square meter of the photographic material.

10. The method as claimed in claim 1, wherein the coating amount of silver in silver halide emulsion layer of the photographic material is 0.4 to 0.7 g per square meter of the photographic material.

11. The method as claimed in claim 1, wherein the photographic material contains a yellow coupler represented by formula (Y) and a magenta coupler represented by the following formula (M-II):

Formula (M-II)

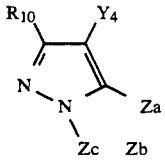

wherein $R_{10}$ represents a hydrogen atom or a substituent, $Y_4$ represents a hydrogen atom, or a group capable of being released upon coupling reaction with the oxidized product of an aromatic primary amine color developing agent, $Z_a$, $Z_b$, and $Z_c$ each represent a methine, —N=, or —NH—, one of the $Z_a$—$Z_b$ bond and the $Z_b$—$Z_c$ bond is a double bond and the other is a single bond, and when the $Z_b$—$Z_c$ bond is a carbon-carbon double bond it may be part of the aromatic ring.

12. The method as claimed in claim 1, wherein the method is used in a continuous processing of silver halide color photographic material.

13. The method as claimed in claim 1, wherein the color developer is substantially free from benzyl alcohol.

14. The method as claimed in claim 1, wherein the color developer contains $3\times10^{-2}$ to $1.5\times10^{-1}$ mol of chloride ions and $3\times10^{-5}$ to $1\times10^{-3}$ mol of bromide ions, per liter of the color developer.

15. The method as claimed in claim 1, wherein the processing time with the color developer is 20 to 60 seconds.

16. The method as claimed in claim 1, wherein the processing temperature with the color developer is 33° to 45° C.

17. The method as claimed in claim 1, wherein the color developer is provided with a replenisher and the amount of replenisher of the color developer is 20 to 350 ml per square meter of the photographic material.

18. The method as claimed in claim 1, wherein the processing time with the color developer is 20 to 60 seconds.

19. The method as claimed in claim 1, wherein the photographic material is taken out of the color developer and brought into contact with a bleach-fixing solution and the pH of the bleach-fixing solution is 4 to 7.

20. The method as claimed in claim 1, wherein $R_{11}$ of formula (Y) represents a halogen atom or an alkoxy group.

21. The method as claimed in claim 1, wherein A of formula (Y) represent $—NHCOR_{13}$ or $—SO_2NR_{13}$.

* * * * *